US010762827B2

(12) United States Patent
Nakao et al.

(10) Patent No.: US 10,762,827 B2
(45) Date of Patent: Sep. 1, 2020

(54) SIGNAL SUPPLY CIRCUIT AND DISPLAY DEVICE

(71) Applicant: Japan Display Inc., Minato-ku (JP)

(72) Inventors: Takayuki Nakao, Tokyo (JP); Takehiro Shima, Tokyo (JP)

(73) Assignee: Japan Display Inc., Minato-ku (JP)

( * ) Notice: Subject to any disclaimer, the term of this patent is extended or adjusted under 35 U.S.C. 154(b) by 0 days.

(21) Appl. No.: 16/368,365

(22) Filed: Mar. 28, 2019

(65) Prior Publication Data

US 2019/0221151 A1 Jul. 18, 2019

Related U.S. Application Data

(63) Continuation of application No. 15/405,616, filed on Jan. 13, 2017, now Pat. No. 10,311,772.

(30) Foreign Application Priority Data

Jan. 13, 2016 (JP) ..... 2016-004077

(51) Int. Cl.
*G09G 3/36* (2006.01)
*G09G 3/20* (2006.01)

(52) U.S. Cl.
CPC ..... *G09G 3/2074* (2013.01); *G09G 3/2003* (2013.01); *G09G 3/2092* (2013.01); *G09G 3/3648* (2013.01); *G09G 3/3688* (2013.01); *G09G 3/3614* (2013.01); *G09G 2300/0439* (2013.01); *G09G 2300/0452* (2013.01); *G09G 2300/0857* (2013.01); *G09G 2320/0666* (2013.01)

(58) Field of Classification Search
CPC ..... G09G 3/18; G09G 2300/04–0895; G09G 2310/00–08; G09G 2340/04–16
See application file for complete search history.

(56) References Cited

U.S. PATENT DOCUMENTS

2003/0174108 A1 9/2003 Kasai
2003/0231191 A1* 12/2003 Glen ..... G09G 5/363 345/690
2009/0153533 A1* 6/2009 Umeda ..... G09G 3/3607 345/204
2009/0207325 A1* 8/2009 Sugimoto ..... G02B 26/0841 348/750

(Continued)

FOREIGN PATENT DOCUMENTS

JP 2013-186294 9/2013
JP 2014-186283 10/2014

*Primary Examiner* — Sanghyuk Park
(74) *Attorney, Agent, or Firm* — Oblon, McClelland, Maier & Neustadt, L.L.P.

(57) ABSTRACT

According to an embodiment, in a display device, pixels have memories respectively. A signal supply circuit includes a mode control circuit, and switches into a first mode or a second mode to supply digital data pieces to sub-pixels. In the first mode, the circuit receives from the outside first video data pieces corresponding to n sub-pixels, and supplies digital data pieces for the n sub-pixels to corresponding memories. In the second mode, the signal supply circuit receives from the outside second video data pieces corresponding to m sub-pixels fewer than n sub-pixels, and supplies digital data pieces for the n sub-pixels to corresponding memories based on the second video data pieces.

14 Claims, 28 Drawing Sheets

(56) References Cited

U.S. PATENT DOCUMENTS

| | | | | |
|---|---|---|---|---|
| 2012/0162272 | A1* | 6/2012 | Lee | G09G 5/10 345/690 |
| 2014/0285761 | A1 | 9/2014 | Tamaki et al. | |
| 2016/0117808 | A1* | 4/2016 | Han | G06T 3/4007 345/606 |

* cited by examiner

| Data piece D1 (R) | SW31 | SW32 | SW33 | SW34 |
|---|---|---|---|---|
| Four bit mode | On | Off | Off | Off |
| Three bit mode | On | Off | Off | Off |
| One bit mode(*1) | On | Off | Off | Off |
| Others | Off | Off | Off | Off |

(*1) Red, Magenta, Yellow, White

FIG. 11A

| Data piece D2 (G) | SW31 | SW32 | SW33 | SW34 |
|---|---|---|---|---|
| Four bit mode | Off | On | Off | Off |
| Three bit mode | Off | On | Off | Off |
| One bit mode(*2) | On | Off | Off | Off |
| Others | Off | Off | Off | Off |

(*2) Green, Cyan, Yellow, White

FIG. 11B

| Data piece D3 (B) | SW31 | SW32 | SW33 | SW34 |
|---|---|---|---|---|
| Four bit mode | Off | Off | On | Off |
| Three bit mode | Off | Off | On | Off |
| One bit mode(*3) | On | Off | Off | Off |
| Others | Off | Off | Off | Off |

(*3) Blue, Cyan, Magenta, White

FIG. 11C

| Data piece D4 (W) | SW31 | SW32 | SW33 | SW34 |
|---|---|---|---|---|
| Four bit mode | Off | Off | Off | On |
| Three bit mode | Off | Off | Off | On |
| One bit mode(*4) | On | Off | Off | Off |
| Others | Off | Off | Off | Off |

(*4) White

FIG. 11D

| Operation mode | M1 | M2 |
|---|---|---|
| Four bit mode (R, G, B, W) | 0 | 0 |
| Four bit mode (R, G, B, DUM) | 0 | 1 |
| Three bit mode | 1 | 0 |
| One bit mode | 1 | 1 |

F I G. 13

| Color | C1 | C2 | C3 |
|---|---|---|---|
| Black | 0 | 0 | 0 |
| Red | 1 | 0 | 0 |
| Green | 0 | 1 | 0 |
| Blue | 0 | 0 | 1 |
| White | 1 | 1 | 1 |

F I G. 14A

| Color | C1 | C2 | C3 |
|---|---|---|---|
| White | 1 | 1 | 1 |
| Cyan | 0 | 1 | 1 |
| Magenta | 1 | 0 | 1 |
| Yellow | 1 | 1 | 0 |
| Black | 0 | 0 | 0 |

F I G. 14B

SIGNAL SUPPLY CIRCUIT AND DISPLAY DEVICE

CROSS-REFERENCE TO RELATED APPLICATIONS

This application is a continuation of U.S. patent application Ser. No. 15/405,616, filed Jan. 13, 2017, now pending, which is based upon and claims the benefit of priority from Japanese Patent Application No. 2016-004077, filed Jan. 13, 2016, the entire contents of both of which are incorporated herein by reference.

FIELD

Embodiments described herein relate generally to a signal supply circuit and a display device.

BACKGROUND

A liquid crystal display device capable of color display comprises a display panel. The display panel comprises pixels which are arranged in rows and columns (along an X-axis and a Y-axis). The X-axis orthogonally intersects the Y-axis. Each of the pixels comprises a color filter and operates as a red (R) sub-pixel, a green (G) sub-pixel, or a blue (B) sub-pixel.

In recent years, a technique of improving display luminance of a display panel has been proposed. As an example, an R sub-pixel, a G sub-pixel, a B sub-pixel, and a white (W) sub-pixel are arranged in a row in a predetermined order, and these four sub-pixels form one set that constitutes one pixel. The white (W) sub-pixel is higher in light utilizing efficiency than any of the R sub-pixel, the G sub-pixel, and the B sub-pixel, and is three times as high in transmittance as any of the R sub-pixel, the G sub-pixel, and the B sub-pixel. Therefore, use of a white sub-pixel (W) in a composite color unit pixel will raise a display device in display intensity.

However, external devices that are used to supply video data (which may also be called image data) to a display panel generally output RGB video signals. Namely, conventional external devices do not output W video signals for W sub-pixels. This is because a video signal generally comprises an R video signal component, a G video signal component, and a B video signal component.

If the above-mentioned new type display panel and a conventional external device are integrated with each other to form a liquid crystal display device, the following new problems will occur.

(1) A new conversion circuit will be required to generate W video signals.

(2) Provision of a conversion circuit will increase the number of sub-pixels from three (an R sub-pixel, a G sub-pixel, and a B sub-pixel) to four (an R sub-pixel, a G sub-pixel, a B sub-pixel, and a W sub-pixel). Therefore, a total count of data pieces required for driving a liquid crystal display device will increase. As a result, time required for transmission of data will be long and electric power consumption will increase.

(3) Data processing will be complicated.

BRIEF DESCRIPTION OF THE DRAWINGS

FIG. 11A illustrates an on-off state in which each of switches SW31, SW32, SW33, and SW34 is brought by a serial-parallel converted data piece D1 when a signal supply circuit operates in one of a four bit mode, a three bit mode, a one bit mode, and the others.

FIG. 11B illustrates an on-off state in which each of the switches SW31, SW32, SW33, and SW34 is brought by a serial-parallel converted data piece D2 when the signal supply circuit operates in one of the four bit mode, the three bit mode, the one bit mode, and the others.

FIG. 11C illustrates an on-off state in which each of the switches SW31, SW32, SW33, and SW34 is brought by a serial-parallel converted data pieces D3 when the signal supply circuit operates in one of the four bit mode, the three bit mode, the one bit mode, and the others.

FIG. 11D illustrates an on-off state in which each of the switches SW31, SW32, SW33, and SW34 is brought by a serial-parallel converted data piece D4 when the signal supply circuit operates in one of the four bit mode, the three bit mode, the one bit mode, and the others.

FIG. 13 illustrates an exemplary control data piece which a serial-parallel-conversion circuit uses.

FIG. 14A illustrates an exemplary control data piece which a line data generation circuit 1120 uses.

FIG. 14B illustrates another exemplary control data piece which the line data generation circuit 1120 uses.

DETAILED DESCRIPTION

Figure 1:
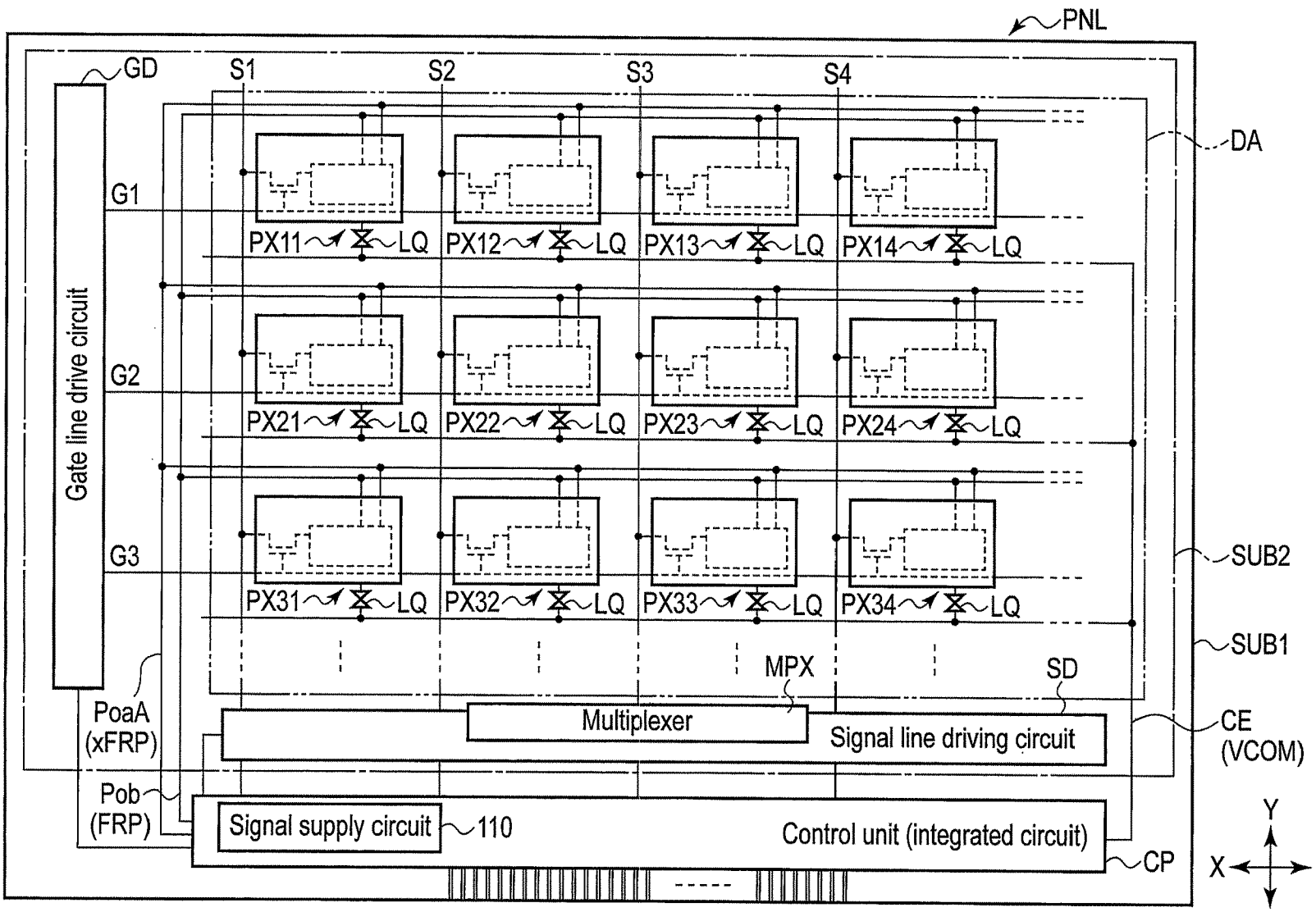
FIG. 1 schematically illustrates an overall structure which a display device comprising a signal supply circuit in one embodiment has.

Various embodiments will be described hereinafter with reference to the accompany drawings.

Each embodiment aims at providing a signal supply circuit and a display device, both achieving increase in data transfer rate and reduction in electric power consumption by supplying to a display panel data pieces having been adjusted according to the performance of an external device.

One embodiment provides a signal supply circuit which is used in such a display device that comprises pixels, each pixel comprising sub-pixels having their respective memories. The signal supply circuit includes a mode control circuit which controls the operation mode of the signal supply circuit. The signal supply circuit can be selectively switched into a first mode and second mode, for supplying digital data pieces to the memories in the respective sub-pixels constituting a pixel. The mode control circuit selectively changes the operation mode of the signal supply circuit between the first mode and the second mode. In the first mode, the first video data pieces corresponding to n sub-pixels are externally received. Based on the first video data, the digital data pieces for n sub-pixels are supplied to the respective memories. In the second mode, second video data pieces corresponding to m sub-pixels fewer than n sub-pixels are externally received. Based on the second video data, the digital data pieces for n sub-pixels are adaptively supplied to the respective memories.

Embodiments will be described in detail hereinafter with reference to the accompanying drawings. It should be noted that each disclosed embodiment is merely an example, and any changes, which may be easily conceived by a skilled person according to the circumstances but will fall within the spirit of the invention, ought to be included in the scope of the invention as a matter of course. In addition, in some cases, in order to make the description clearer, the widths, thicknesses, shapes, etc. of the respective parts are schematically illustrated in the drawings, compared to the actual modes. However, the schematic illustration is merely an example, and adds no restrictions to the interpretation of the invention.

In addition, in the specification and drawings, the structural elements, which have functions identical or similar to the functions described in connection with preceding drawings, are denoted by like reference numbers, and an overlapping detailed description thereof is omitted unless otherwise necessary. It should be noted that the following explanation uses such terms as color filters R, G, B, W, sub-pixels R, G, B, W, video data pieces R, G, B, color filters R, G, B, W, output lines R, G, B, W, and signals R, G, B, W, in which R, G, B, W respectively stand for Red, Green, Blue, and White. It should be further noted that the sub-pixels R, G, B, W respectively stand for a sub-pixel having a color filter R, a sub-pixel having a color filter G, a sub-pixel having a color filter B, and a sub-pixel having a color filter W. Moreover, the output lines R, G, B, W mean those lines that output video-data pieces which should be distributed to the respective sub-pixels R, G, B, W. The video data pieces R, G, B mean those video data pieces that should be somehow distributed to the sub-pixels R, G, B, W.

FIG. 1 schematically illustrates an exemplary structure which a display panel PNL has. A display device comprises a display panel PNL of an active matrix type. The display panel PNL comprises a first substrate SUB1, a second substrate SUB2 facing the first substrate SUB1, and a liquid crystal layer LQ held between the first substrate SUB1 and the second substrate SUB2. The second substrate SUB2 is indicated by alternate long and short dashed lines. An area where the liquid crystal layer LQ is held between the first substrate SUB1 and the second substrate SUB2 constitutes a display area DA. The display area DA is, for example, rectangular. In this area, a plurality of sub-pixels PX (PX11, PX12, . . . ) are arranged in matrix.

The first substrate SUB1 comprises a plurality of gate lines G (G1 to Gn) extending along a first axis X, and a plurality of signal lines S (S1 to Sm) extending along a second axis Y orthogonal to the first axis X and orthogonally intersecting with the gate lines G.

The gate lines G (G1 to Gn) are drawn outside the display area DA and are connected to a gate line drive circuit (a first drive circuit) GD. The signal lines S (S1 to Sm) are drawn outside the display area DA and are connected to a source line drive circuit (a second drive circuit) SD. The first drive circuit GD and the second drive circuit SD are at least partially provided on the first substrate SUB1, for example, and are connected to a control device (which may be referred to as a driving IC chip or a liquid crystal driver) CP.

The second drive circuit SD comprises a multiplexer MPX in order to divide a pixel signal received from the control device CP among those sub-pixels that constitute a corresponding pixel. Those signal lines that correspond to the respective sub-pixels are used for the allocation of the pixel signal. Namely, the multiplexer MPX applies received pixel signals to appropriate signal lines for the suitable sub-pixels.

The control device CP comprises a built-in clock-and-timing-pulse generation circuit (which may be referred to as a controller or a sequencer) in order to control the first drive circuit GD and the second drive circuit SD, and serves as a signal supply source for supplying signals necessary to drive the liquid crystal display panel LPN. The control device CP includes a signal supply circuit 110. The signal supply circuit 110 includes a mode control circuit (which will be described later) which changes operation mode according to the type of video data pieces when it supplies video data pieces to the second drive circuit SD. The types of video data will be explained later in detail, but there are at least four types as follows. A first type of video data comprises a red (R), a green (G), and a blue (B) data piece. A second type of video data comprises a red (R), a green (G), a blue (B), and a white (W) data piece. A third type of video data comprises a red (R), a green (G), a blue (B), and a dummy (DUM) data piece. The last type of video data comprises mere one bit data.

In the example illustrated in FIG. 1, the control device CP is mounted on the first substrate SUB1 and is located outside the display area DA of the display panel PNL.

A common electrode CE is formed of a transparent material on the second substrate SUB2 in such a manner that the common electrode CE covers the entire display area DA and is jointly used by all the sub-pixels PX, for instance. The common electrode CE is drawn outside the display area DA and is connected to a power supply module provided inside the control device CP. The power supply module outputs a prescribed common voltage. The common electrode CE may be formed on the first substrate SUB1 in such a manner that an insulation material is between the common electrode CE and pixel electrodes.

Sub-pixels PX have their respective color filters, and are arranged in accordance with predetermined color regulations. The color filters face the pixel electrodes with the liquid crystal layer LQ interposed there-between and are formed on the second substrate SUB2.

Figure 2A:
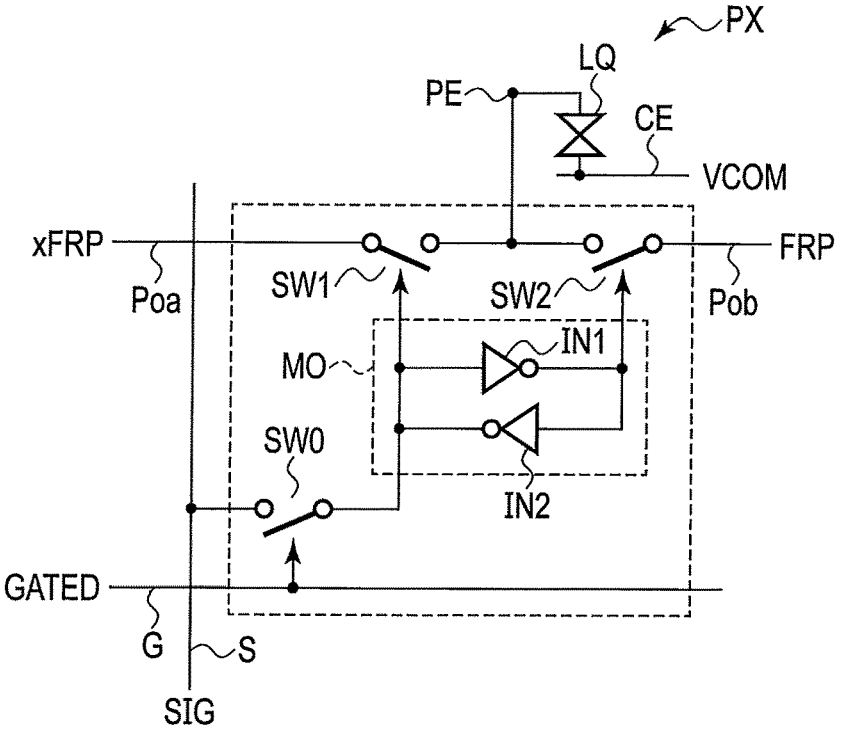
FIG. 2A is a circuit diagram illustrating a basic structure which a sub-pixel including a memory has.

FIG. 2A illustrates a structure which a sub-pixel PX (or pixel) including a memory M0 has. The sub-pixel PX has a switch SW0, a switch SW1, and a switch SW2. The switch SW0 has two ends, one being connected to one of the signal lines S, and the other to the memory M0. The switch SW1 and the switch SW2 each have a control terminal, an input terminal and an output terminal. The memory M0 comprises, for example, inverters IN1 and IN2. The inverters IN1 and IN2 are connected in parallel and reverse to each other. The inverters IN1 and IN2 each have an input terminal and an output terminal. The input terminal of the inverter IN1 (the output terminal of the inverter IN2) is connected to the control terminal of the switch SW1. The output terminal of the inverter IN1 (the input terminal of the inverter IN2) is connected to the control terminal of the switch SW2. The input terminal of the switch SW1 is connected to a first signal line Poa. The output terminal of the switch SW1 is connected to a pixel electrode PE which one of the display elements formed in the liquid crystal layer has. The input terminal of the switch SW2 is connected to a second signal line Pob. The output terminal of the switch SW2 is connected to the pixel electrode PE. A first signal (display signal) xFRP flows through the first signal line Poa. A second signal (non-display signal) FRP flows through the second signal line Pob. The first signal xFRP and the second signal FRP are alternating signals opposite to each other in phase, and are generated by the control device CP having been explained with reference to FIG. 1. The control device CP supplies a common signal VCOM to every one of the common electrodes CE facing the respective pixel electrodes PE. The common signal VCOM is an alternating current signal which is the same in phase as the second signal FRP.

Figure 2B:
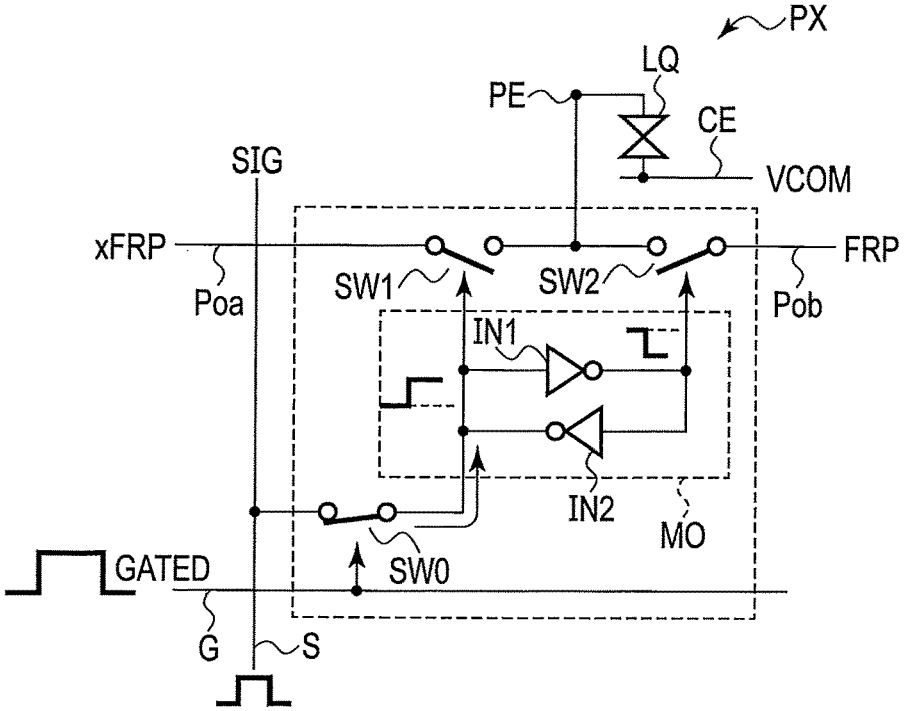
FIG. 2B illustrates an exemplary operation which a sub-pixel having a memory performs when a data piece is written into the memory.

FIG. 2B illustrates an exemplary operation when data "1" is written into the memory M0 which the above sub-pixel PX has. When a gate pulse GATED is supplied to the gate line G and a signal SIG (data "1") is supplied to the signal line S, the switch SW0 will be turned on, and data "1" (high in level) will be written into and kept in the memory M0. At this moment, the inverter IN1 will invert the input. Therefore, the output of the inverter IN1 will be 0 (low in level). Since the input of the inverter IN2 is low in level, the output of inverter IN2 will be high in level. When the switch SW0 is turned off at this moment, the data "1" will be kept in the memory M0.

Figure 3:
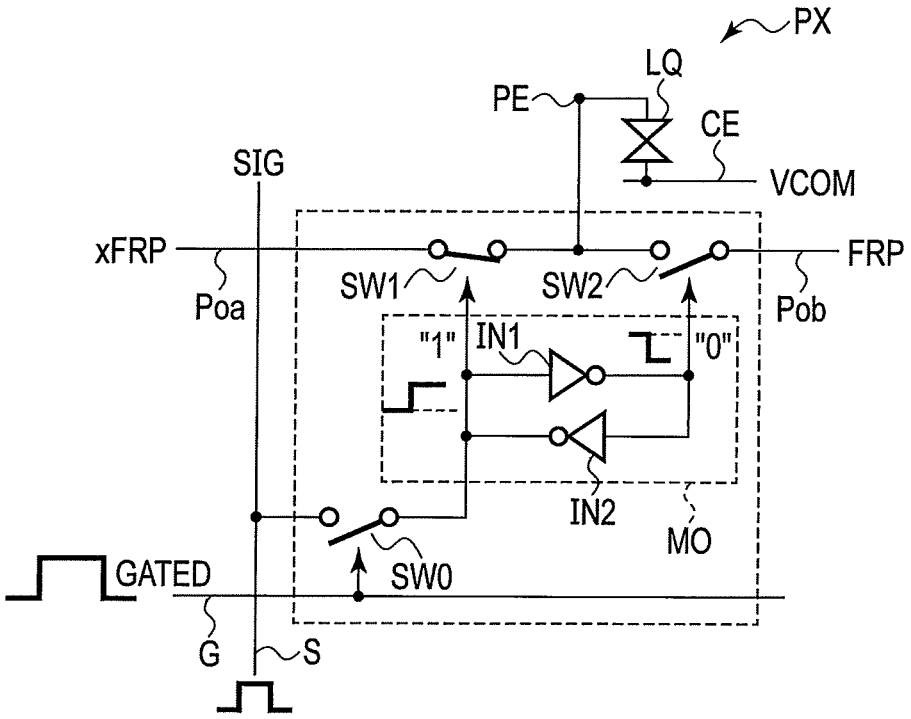
FIG. 3 illustrates an exemplary state in which a sub-pixel having a memory is while a data piece is stored in the memory (while a display period lasts).

Namely, when the switch SW0 is turned off and the data "1" is kept in the memory M0, the output of the memory M0 will turn the switch SW1 on whereas the switch SW2 off, as illustrated in FIG. 3. As a result, the first signal xFRP is supplied to the pixel electrode PE of the display element (liquid crystal layer) LQ. The common signal VCOM is supplied to the common electrode CE.

Figure 4:
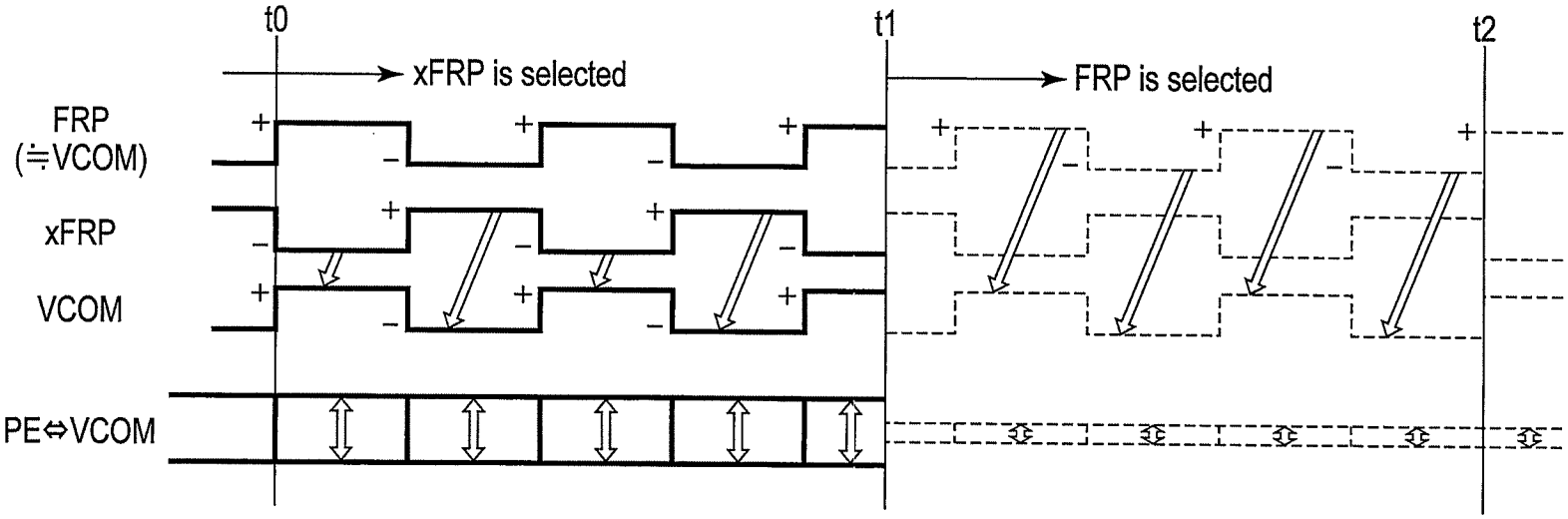
FIG. 4 exemplarily illustrates waveforms and a stored data piece for explaining an exemplary operation which a sub-pixel having a memory executes while the data piece is stored in the memory (while a display period lasts).

FIG. 4 illustrates the change of potential difference which a sub-pixel PX has and which is produced between a pixel electrode PE and a common electrode CE. FIG. 4 illustrates a situation in which a first signal xFRP is applied to a pixel electrode P and a common signal VCOM is applied to a common electrode CE, both occurring during a period of time t0-t1. The first signal xFRP and the common signal VCOM are opposite in phase. Accordingly, high potential difference occurs between the pixel electrode PE and the common electrode CE. At this time, the display element is brought in a display state. It is assumed here that data "0" is kept in the memory M0. In this case, the switch SW1 is turned off, and the switch SW2 is turned on. Thus, as illustrated in FIG. 4, the second signal FRP is applied to the pixel electrode PE, and the common signal VCOM is applied to the common electrode CE, both occurring during a period of time t1-t2. At this time, the second signal FRP and the common signal VCOM are the same in phase. Accordingly, potential difference between the pixel electrode PE and the common electrode CE will be low. At this time, the display element is brought in a non-display state.

Figure 5:
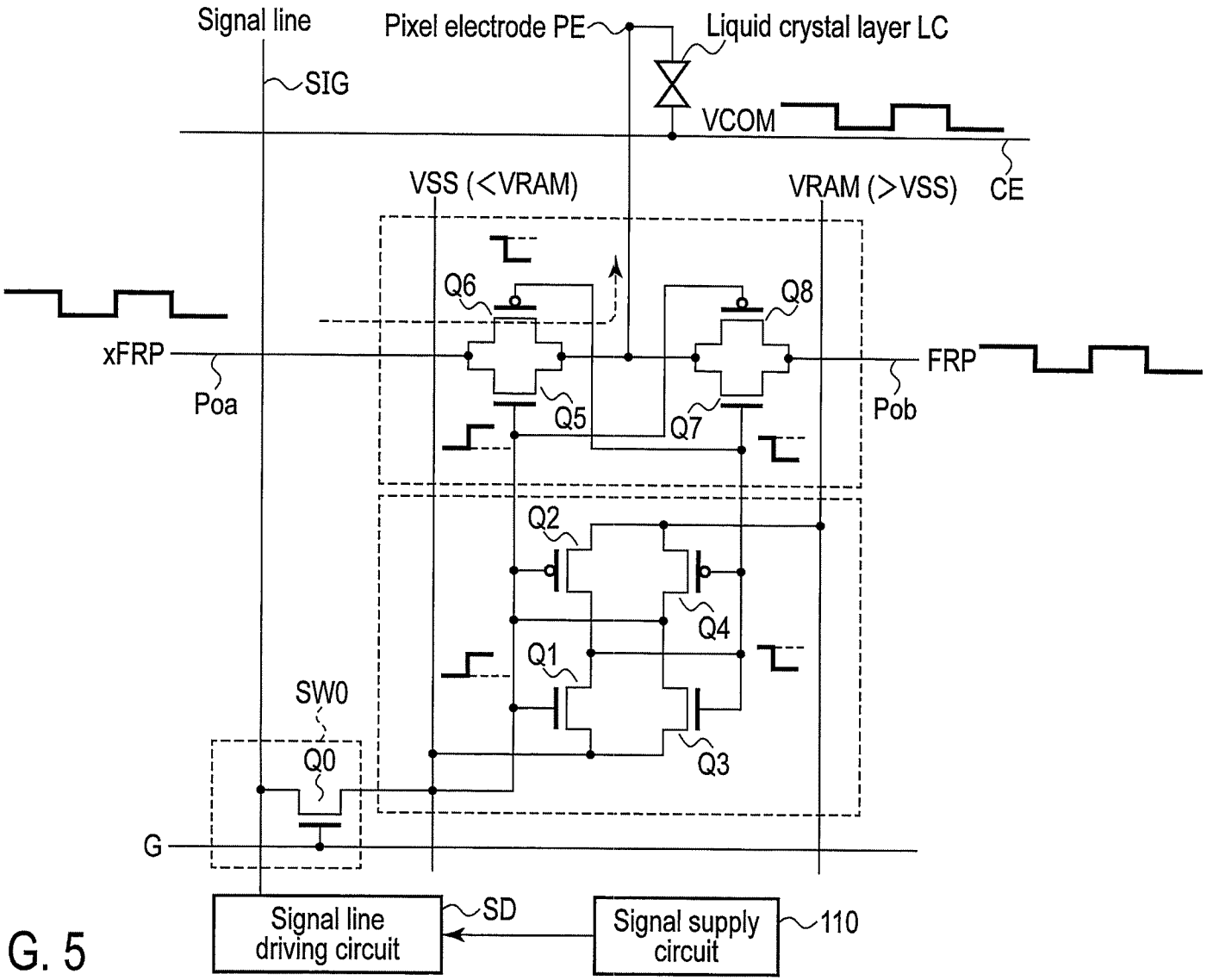
FIG. 5 is a circuit diagram minutely illustrating the circuit structure illustrated in FIG. 2A.

FIG. 5 illustrates in more detail a circuit structure which a sub-pixel illustrated in FIG. 2A, FIG. 2B and FIG. 3 has. The switch SW0 is made of a thin-film transistor Q0, for example. The memory M0 is made of thin-film transistors Q1, Q2, Q3 and Q4. The switch SW1 is made of thin-film transistors Q5 and Q6. The switch SW2 is made of thin-film transistors Q7 and Q8. When data "1" is written into the memory M0, the thin-film transistors Q1 and Q4 are turned on, and the thin-film transistors Q2 and Q3 are turned off. The memory M0 causes trough its outputs the thin-film transistors Q5 and Q6 to turn on, and the thin-film transistors Q7 and Q8 to turn off. When data "0" is written into the memory M0, the thin-film transistors Q2 and Q3 are turned off, and the thin-film transistors Q1 and Q4 are turned off. The memory M0 causes trough its outputs the thin-film transistors Q5 and Q6 to turn off, and the thin-film transistors Q7 and Q8 to turn on.

Figure 6:
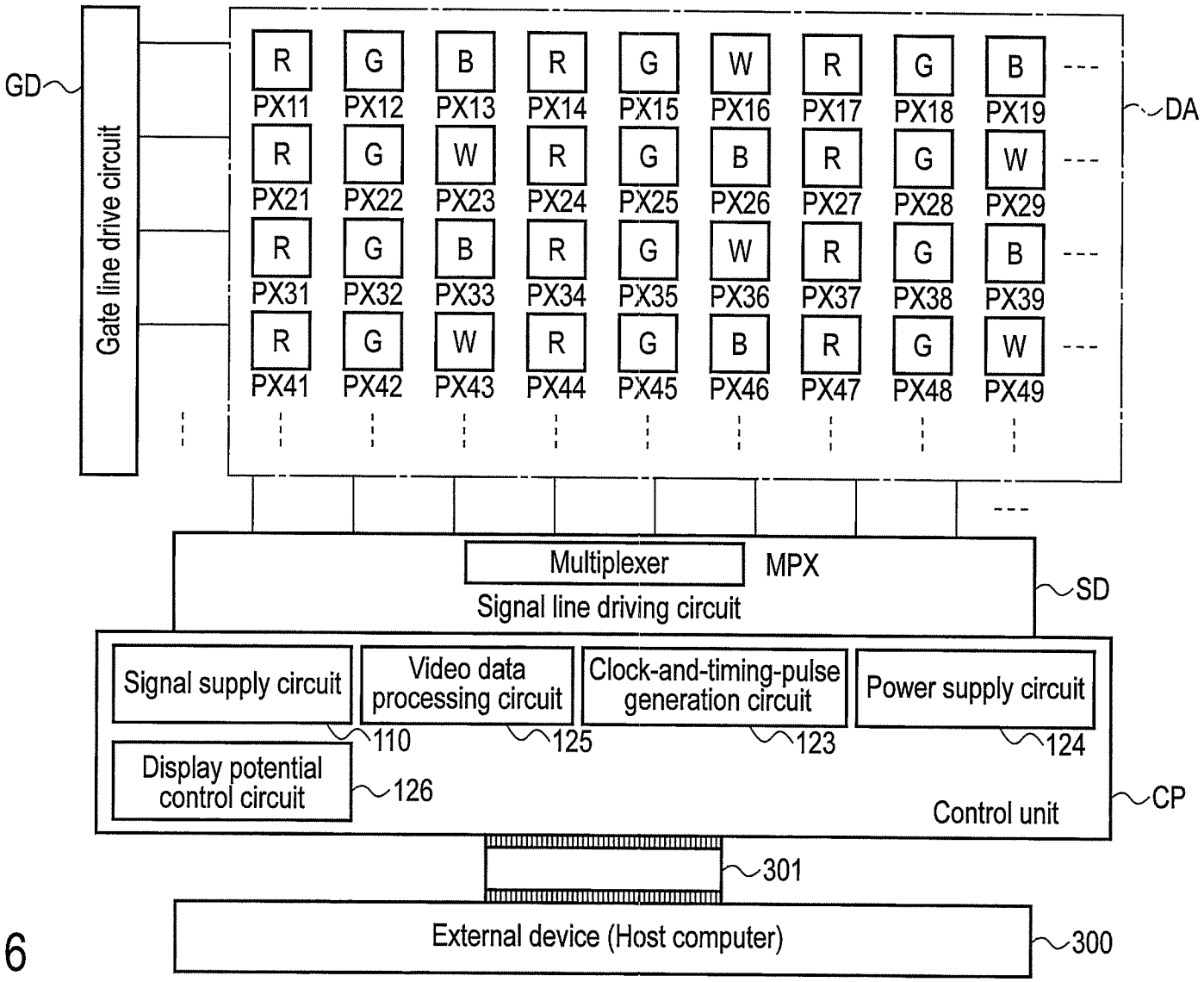
FIG. 6 particularly illustrates constituents of a control unit in the display device equipped with the signal supply circuit in the one embodiment.

FIG. 6 particularly illustrates constituents of a control unit which the display device having the signal supply circuit in the one embodiment has. Moreover, how the sub-pixels PX having their respective color filters are exemplarily arranged in the display area DA of the display panel PNL is also illustrated. The arrangement order of color filters is not restricted to the illustrated example. There are various kinds of arrangement order. In this embodiment, color filters R are arranged in a first column, and color filters G are arranged in a second column. Color filters B and color filters W are alternately arranged in a third column. Color filters R are arranged in a fourth column, and color filters G are arranged in a fifth column. Color filters B and color filters W are alternately arranged in a sixth column. Such color filter arrangement order is repeated along the X-axis. Here, when you see the third column, the sixth column, and the ninth column along any one row (along the X-axis), you will find that the color filters W and B alternate with each other along each of the rows.

Alternatively, it may also be possible to squarely arrange four color sub-pixels R, G, B and W. Specifically, it is possible that PX11, PX31, and PX13 may be set to R, PX21, PX41, and PX23 may be set to G, PX12, PX32, PX14 may be set to B, and PX22, PX42, and PX24 may be set to W.

The control unit CP includes not only the signal supply circuit 110 but also a power supply circuit 124, a clock-and-timing-pulse generation circuit 123, a video data processing circuit 125, a display potential control circuit 126, and so forth. The power supply circuit 124 generates various kinds of voltage using the power supply voltage received from the external battery. The clock-and-timing-pulse generation circuit 123 generates various kinds of clocks and various kinds of timing signals for use in the control unit CP, the gate line driving circuit GD, a signal line driving circuit SD, and so forth.

The control unit CP receives a video signal, a synchronization signal, control data, etc. from an external device (you may call a host computer) 300 through connection lines which a flexible substrate 301 has. The video signal and the synchronization signal are inputted into the video data processing circuit 125, and are changed into such video data that is suitable for the display panel PNL. The control data is taken into the clock-and-timing-pulse generation circuit 123, and is used to control operation of the display device. It is possible that the display potential control circuit 126 in the control unit CP may make alteration to the first signal xFRP or the second signal FRP, both of which has been explained with reference to FIGS. 2A, 2B, and 3, and may supply the altered signal to a pixel electrode in order to obtain a special display status, such as a status in which whites and blacks are reversely lit, or a status in which negatives and positives are reversely lit, for instance.

Figure 7:
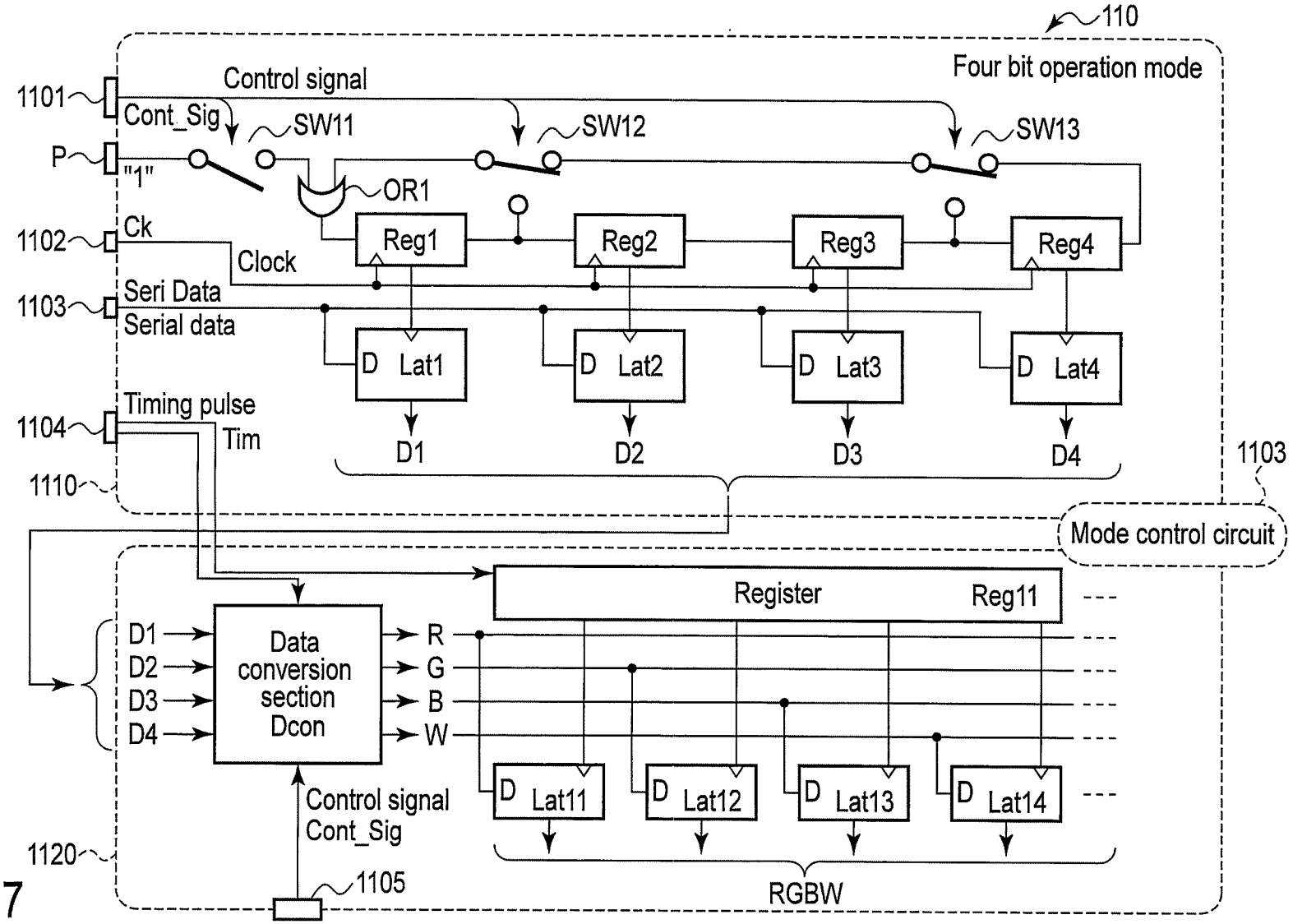
FIG. 7 illustrates a first operation mode into which the signal supply circuit in the control unit is put.

FIG. 7 illustrates an exemplary specific structure which the signal supply circuit 110 has. The signal supply circuit 110 has a serial-parallel-conversion circuit 1110, which subjects to parallel conversion the video data pieces having been inputted as a series of serially supplied data pieces, and a line data generation circuit 1120, which collects the parallel converted video data pieces and prepares as much parallel converted video data pieces as suitable for one line, for example. The serial-parallel-conversion circuit 1110 can change its own operation mode. The serial-parallel-conversion circuit 1110 has a mode control circuit 1103 for changing its own operation mode.

The serial-parallel-conversion circuit 1110 has an input terminal 1101 which receives first control data Cont_Sig from the mode control circuit 1103. Moreover, the line data generation circuit 1120 also has an input terminal 1105 which receives second control data Cont_Sig from the mode control circuit 1103.

The serial-parallel-conversion circuit 1110 has a switch SW11 and an OR circuit OR1. When data "1" is inputted from an initial value input terminal P and a switch SW11 is turned on by the control data Cont_Sig, data "1" is latched into a register Reg1. After data "1" has been latched into the register Reg1, the switch SW11 is turned off. It is organized in such a manner that the register Reg1 supplies its output to a register Reg2, the register Reg2 supplies its output to a register Reg3, the register Reg3 supplies its output to a register Reg4. The data "1" inputted into the register Reg1 is sequentially transmitted to the register Reg2, the register Reg3, and the register Reg4 with the clock inputted into the input terminal 1102. It should be noted that the circuit comprising a plurality of serially connected registers may be called a register series circuit or a counter circuit.

However, the serial-parallel-conversion circuit 1110 has switches SW12 and SW13, and can make a change to a route which the transmitted data takes. The switch SW12 selects either the output of the switch SW13 or the output of the register Reg1, and inputs the selected output to an OR circuit OR1. The switch SW13 selects either the output of the register Reg3 or the output of the register Reg4, and inputs the selected output to the switch SW12. The switches SW12 and SW13 are controlled in their respective switching actions by the control data Cont_Sig from the mode control circuit 1103.

The registers Reg1, Reg2, Reg3, and Reg4 are respectively connected to latching circuits Lat1, Lat2, Lat3, and Lat4. The latching circuits Lat1, Lat2, Lat3, and Lat4 individually have a latching pulse input terminal which determines latching timing of a corresponding one of the latches. The registers Reg1, Reg2, Reg3, and Reg4 supply their respective outputs to the latching pulse input terminals of the respective latching circuits Lat1, Lat2, Lat3, and Lat4. An input terminal 1103 delivers serial video data to data input terminals which the respective latching circuits Lat1, Lat2, Lat3, and Lat4 have. The serial video data may be supplied from the video data processing circuit 125 illustrated in FIG. 6. When the switches SW12 and SW13 are each in such a state as illustrated in FIG. 7, the signal output circuit 110 is in a four bit mode as its operation mode.

Let us suppose here that the serial data is video data which comprises a read (R), a green (G), a blue (B), and a white (W) video data piece. These video data pieces are successively held by the respective latching circuits Lat1, Lat2, Lat3, and Lat4. The read (R), the green (G), the blue (B), and the white (W) video data piece are respectively outputted as a data piece D1, a data piece D2, a data piece D3, and a data piece D4, and flow in parallel with one another. A series of a red (R), a green (G), a blue (B), and a white (W) video data piece is repeatedly supplied as serial data. The latching circuits Lat1, Lat2, Lat3, and Lat4 respectively hold the red (R), the green (G), the blue (B), and the white (W) video data piece in accordance with corresponding outputs supplied from the respective registers Reg1, Reg2, Reg3, and Reg4. These steps are repeated.

The data pieces D1, D2, D3 and D4 respectively outputted from the latching circuits Lat1, Lat2, Lat3, and Lat4 are supplied into a data conversion section Dcon which a line data generation circuit 1120 has, and are respectively changed into an R signal, a G signal, a B signal, and a white (W) signal.

It should be noted that, if a sub-pixel has a one bit memory, the data conversion section Dcon may be eliminated or may exist as a mere buffer circuit for timing adjustment.

The data conversion section Dcon and a register Reg11, both of which are included in the line data generation circuit 1120, are controlled in both data output timing and data transfer timing by a timing pulse Tim from the input terminal 1104. The data conversion section Dcon outputs an R signal, a G signal, a B signal and a W signal, which are respectively held by latching circuits Lat11, Lat12, Lat13, and Lat14 based on latching pulses from the register Reg11. FIG. 7 illustrates four latching circuits Lat11, Lat12, Lat13, and Lat14, but what is actually provided is a latching circuit which holds data pieces for one row.

FIG. 7 illustrates a four bit operation mode, which is effective in a case where an external device 300 outputs video data comprising a read (R) video data piece, a green (G) video data piece, a blue (B) video data piece, and a white (W) video data piece. Alternatively, the four bit operation mode is effective in a case where the external device 300 or the video data processing circuit 125 outputs a white (W) video data piece or a dummy video data piece.

Figure 8:
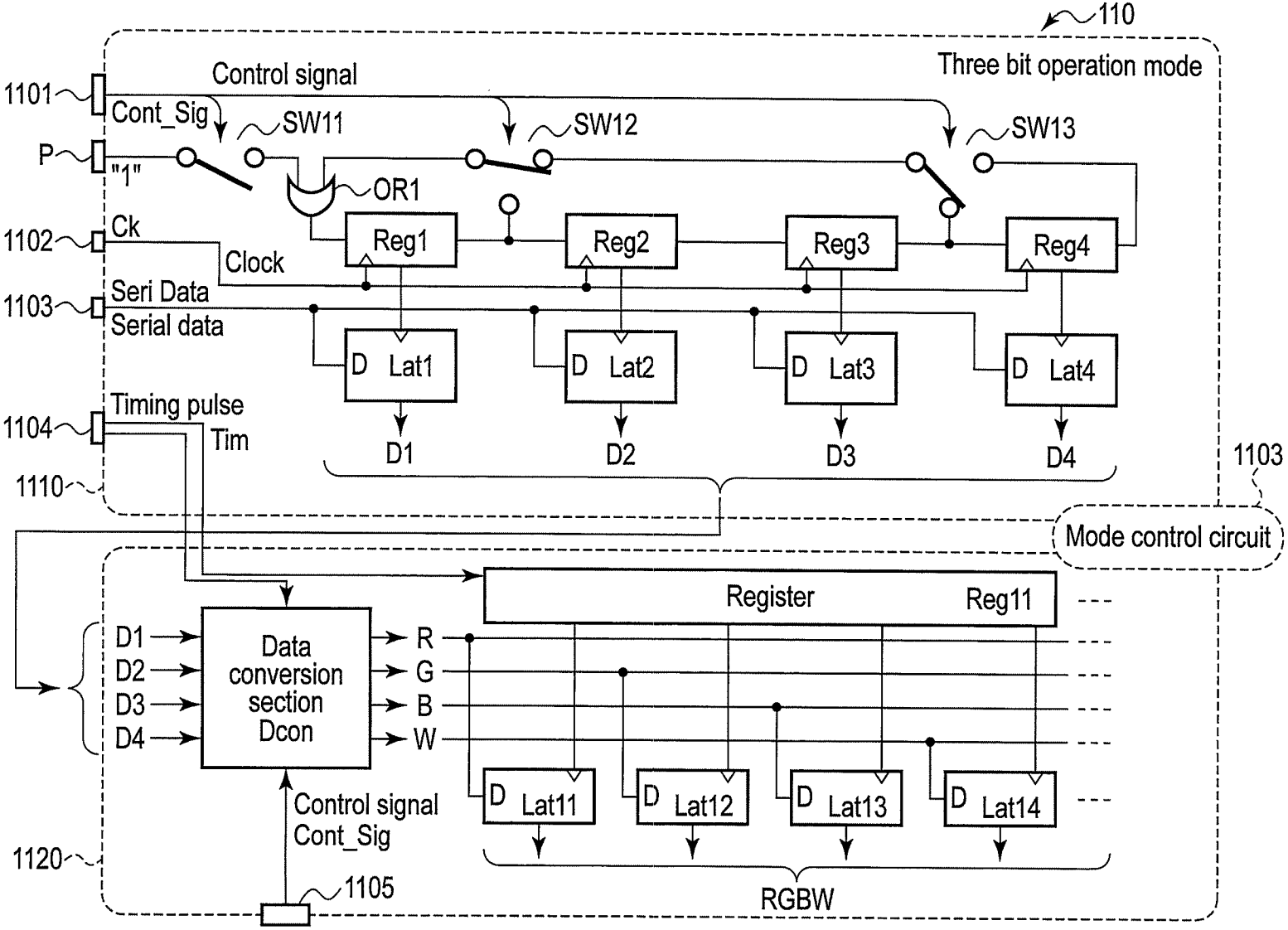
FIG. 8 illustrates a second operation mode into which the signal supply circuit in the control unit is put.

FIG. 8 illustrates a state which the signal supply circuit 110 exhibits after it has been brought into a three bit operation mode under the control of the mode control circuit 1103. The elements equivalent to those illustrated in FIG. 7 are denoted by the same reference numbers. FIG. 8 is different from FIG. 7 in that the switch SW13 selects an output, which the register Reg3 provides, and feeds back the selected output to the register Reg1. This operation mode is effective in a case where the external device 300 outputs video data comprising a read (R) video data piece, a green (G) video data piece, and a blue (B) video data piece, for example. In this case, the data piece D4 will be always zero, which may be used for causing the data conversion section Dcon to generate a W data piece which may be used in place of a white (W) video data piece. The data conversion section Dcon can determine the mode of the presently inputted video data by the control data Cont_Sig inputted from the input terminal 1105. In this mode, the register Reg4 is non-active.

Figure 9:
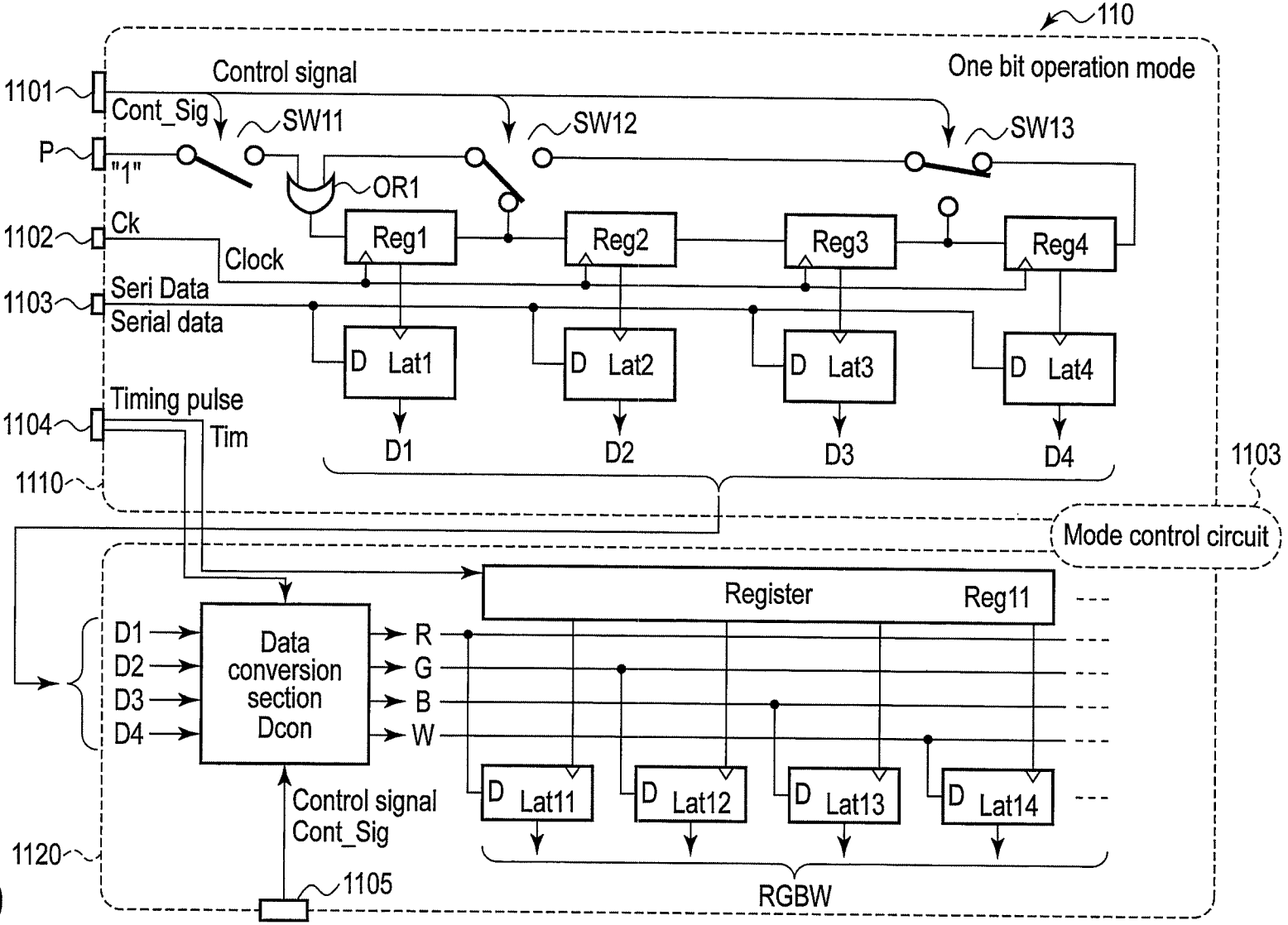
FIG. 9 illustrates a third operation mode into which the signal supply circuit in the control unit is put.

FIG. 9 illustrates a state which the signal supply circuit 110 exhibits after it has been brought into a one bit operation mode. The elements equivalent to those illustrated in FIG. 7 and FIG. 8 are denoted by the same reference numbers. FIG. 9 is different from FIG. 7 and FIG. 8 in that the switch SW12 selects an output, which the register Reg1 provides, and feeds back the selected output to the register Reg1. That is, the parallel conversion section parallel converts externally supplied data to data of a 1-bit unit. In this case, the data pieces D2, D3, and D4 inputted into the data conversion section Dcon are all zeros. The data conversion section Dcon can arbitrarily output the video data pieces G, B, and W corresponding to the data pieces D2, D3, and D4 based on the control data Cont_Sig controlling the operation mode. For example, data that makes the full screen black, white, gray, or monochrome can be outputted. A display format, which is based on the output data, can be arbitrarily set by the control data Cont_Sig and a data conversion table which can be stored in the data conversion section Dcon. In this mode, the registers Reg2, Reg3, and Reg4 are non-active.

Figure 10:
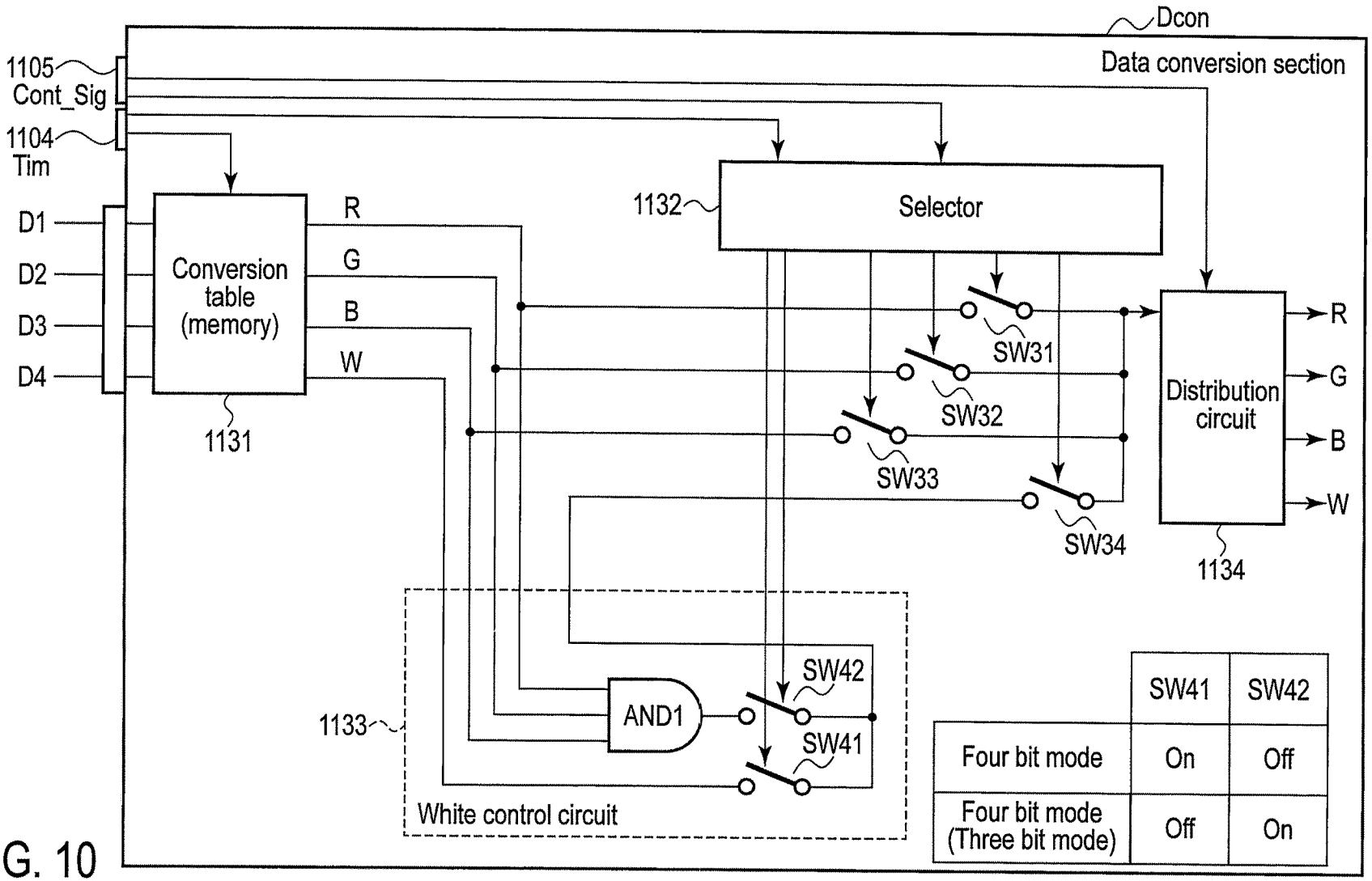
FIG. 10 illustrates an exemplary structure which a data conversion section in a line conversion circuit has.

FIG. 10 illustrates an exemplary internal structure which the data conversion section Dcon has. The data conversion section Dcon has a conversion table (memory) 1131. The conversion table (memory) 1131 can convert the input data pieces D1, D2, D3, D3, and D4 into video data pieces R, G, B, and W, each corresponding in number of bits to the design of the display section. Moreover, the conversion table 1131 may be made in such a manner that it can be exchanged for another one. If a sub-pixel keeps a one bit data piece as illustrated in FIG. 2A-FIG. 3, every one of the outputs corresponding to the respective input data pieces D1, D2, D3, D3, and D4 will also be one bit.

The conversion table (memory) 1131 outputs video data pieces R, G, B, and W, which are respectively selected by the switches SW31, SW32, SW33, and SW34 and are supplied to a distribution circuit 1134. The distribution circuit 1134 distributes signals based on the control data from the input terminal 1105 so that video data pieces R, G, B, and W may be outputted to suitable signal lines (may be assigned to suitable color filters). This process makes it possible, as illustrated in FIG. 6, to input any one of the video data pieces R, G, B, and W to a suitable one of the sub-pixels, each having one of the color filters R, G, B, and W. Accordingly, the distribution circuit 1134 may include a buffer which holds data temporarily. The video data pieces R, G, B and W are suitably supplied to the data input terminals of the respective latching circuits Lat1, Lat2, Lat3, and Lat4.

The video data pieces R, G, and B outputted from the conversion table 1131 are also inputted into a white control circuit 1133. The video data piece W outputted from the conversion table 1131 is also inputted into the white control circuit 1133. The white control circuit 1133 has a synthetic circuit AND1 which uses the video data pieces R, G, and B for supplying a white video data piece W. The synthetic circuit AND1 produces an output (a video data piece W), which successively passes through a switch SW42 and a switch SW34 and flows into the distribution circuit 1134.

When the white control circuit 1133 receives a white video data piece W having been generated at the conversion table 1131 based on the data piece D4, it is possible for the white control circuit 1133 to supply the white video data piece W through the switch SW41 and the switch SW34 to the distribution circuit 1134.

Either the switch SW41 or the switch 42 will be turned on, which will be controlled by a switching signal supplied from a selector 1132. Moreover, each of the switches SW31, SW32, SW33, and SW34 is also turned on or off by a corresponding one of switching signals supplied from the selector 1132.

Fundamentally, in a four bit mode, the switch SW41 is turned on and the switch SW42 is turned off. It is possible to omit the switch SW34. In order to operate the display section in a four bit mode under the condition that the input to the conversion table 1131 is in a three bit mode, and that video data pieces R, G, and B are present whereas a video data piece W is absent, the switch SW41 is turned of and the switch SW42 is turned on. In this case, a pseudo video data piece W prepared from the video data pieces R, G, and B is used.

The above selector 1132 controls the switches SW31-SW34, SW41, SW42, etc. based on the control data Cont_Sig from the input terminal 1105. Moreover, the distribution circuit 1134 also assigns video data pieces R, G, B, and W to the suitable color filters based on the control data Cont_Sig.

FIG. 11A-FIG. 11D illustrate an on-off state in which each of the switches SW31, SW32, SW33, and SW34 is brought for each of the data pieces D1, D2, D3, and D4 when the signal supply circuit operates in one of a four bit mode, a three bit mode, a one bit mode, and the others.

FIG. 11A illustrates a switching status which a signal processing circuit 110 is brought in for the data piece D1 (a red data piece). In the four bit mode, the switch SW31 alone turns on whereas the remaining switches SW32, SW33, and SW34 turn off for the data piece D1. In the three bit mode, the switch SW31 alone turns on whereas the remaining switches SW32, SW33, and SW34 turn off for the data piece D2, too.

It should be noted that, in FIG. 11A, the description indicated by a symbol (*1) means as follows. In the one bit mode in which the data piece for displaying red is externally inputted, only red can be displayed. Alternatively, it is possible to display white alone when there are white color filters. Furthermore, it is possible that a display panel may comprise cyan filters, magenta filters, and yellow filters. In such a case, it is possible to display magenta alone or yellow alone in the one bit mode. At this time, the outputs of the switch SW31 are distributed by the distribution circuit 1134 to those sub-pixels that have either a magenta filter or a yellow filter.

FIG. 11B illustrates a switching status which the signal processing circuit 110 is brought in for the data piece D2 (a green data piece). In the four bit mode, the switch SW31 turns off, the switch SW32 turns on, and the switches SW33 and SW34 turn off for the data piece D2. In the three bit mode, the switch SW31 turns off, the switch SW32 turns on, and the switches SW33 and SW34 turn off for the data piece D2. In the one bit mode, the switch SW31 turns on whereas the remaining switches SW32, SW33, and SW34 turn off for the data piece D2.

It should be noted that, in FIG. 11B, the description indicated by a symbol (*2) means as follows. In the one bit mode in which the data piece for displaying green is externally inputted, only green can be displayed. Alternatively, it is possible to display white alone when there are white color filters. Furthermore, it is possible that a display panel may comprise cyan filters, magenta filters, and yellow filters. In such a case, it is possible to display cyan alone or yellow alone in the one bit mode. At this time, the outputs of the switch SW31 are distributed by the distribution circuit 1134 to those sub-pixels that have either a cyan filter or a yellow filter.

FIG. 11C illustrates a switching status which the signal processing circuit 110 is brought in for the data piece D3 (a blue data piece). In the four bit mode, the switches SW31 and SW32 turn off, the switch SW33 turns on, and the switch SW34 turns off for the data piece D3. In the three bit mode, the switches SW31 and SW32 turn off, the switch SW33 turns on, and the switch SW34 turns off for the data piece D3. In the one bit mode, the switch SW31 turns on whereas the remaining switches SW32, SW33, and SW34 turn off for the data piece D3.

It should be noted that, in FIG. 11C, the description indicated by (*3) means as follows. In the one bit mode in which the data piece for displaying blue is externally inputted, only blue can be displayed. Alternatively, it is possible to display white alone when there are white color filters. Furthermore, it is possible that a display panel may comprise cyan filters, magenta filters, and yellow filters. In such a case, it is possible to display cyan alone or magenta alone in the one bit mode. At this time, the outputs of the switch SW31 are distributed by the distribution circuit 1134 to those sub-pixels that have either a cyan filter or a magenta filter.

FIG. 11D illustrates a switching status which the signal processing circuit 110 is brought in for the data piece D4 (a white data piece). In the four bit mode, the switches SW31, SW32 and SW33 turn off, and the switch SW34 turns on for the data piece D4. In the three bit mode, the switches SW31, SW32 and SW33 turn off, and the switch SW34 turns on for the data piece D4. In the one bit mode, the switch SW31 turns on whereas the remaining switches SW32, SW33, and SW34 turn off for the data piece D4.

It should be noted that, in FIG. 11D, the description indicated by (*4) means as follows. In the one bit mode in which the data piece for displaying white is externally inputted, only white can be displayed. When a display panel which has color filters is used, the distribution circuit 1134 outputs data to respective positions where white filters are located. Furthermore, when the display panel comprises R color filters, G color filters, and B color filters, or when the display panel comprises cyan filters, magenta filters, and yellow filters, the distribution circuit 1134 outputs data "1" to each and every filter.

FIG. 11A-FIG. 11D each illustrate a state in which each of the switches is brought in accordance with difference in data, but not difference in mode. The signal supply circuit may change in its operation mode in actual operation. Therefore, it is also possible to classify the states of every switch in accordance with a four bit mode, a three bit mode, and a one bit mode.

Figure 12:
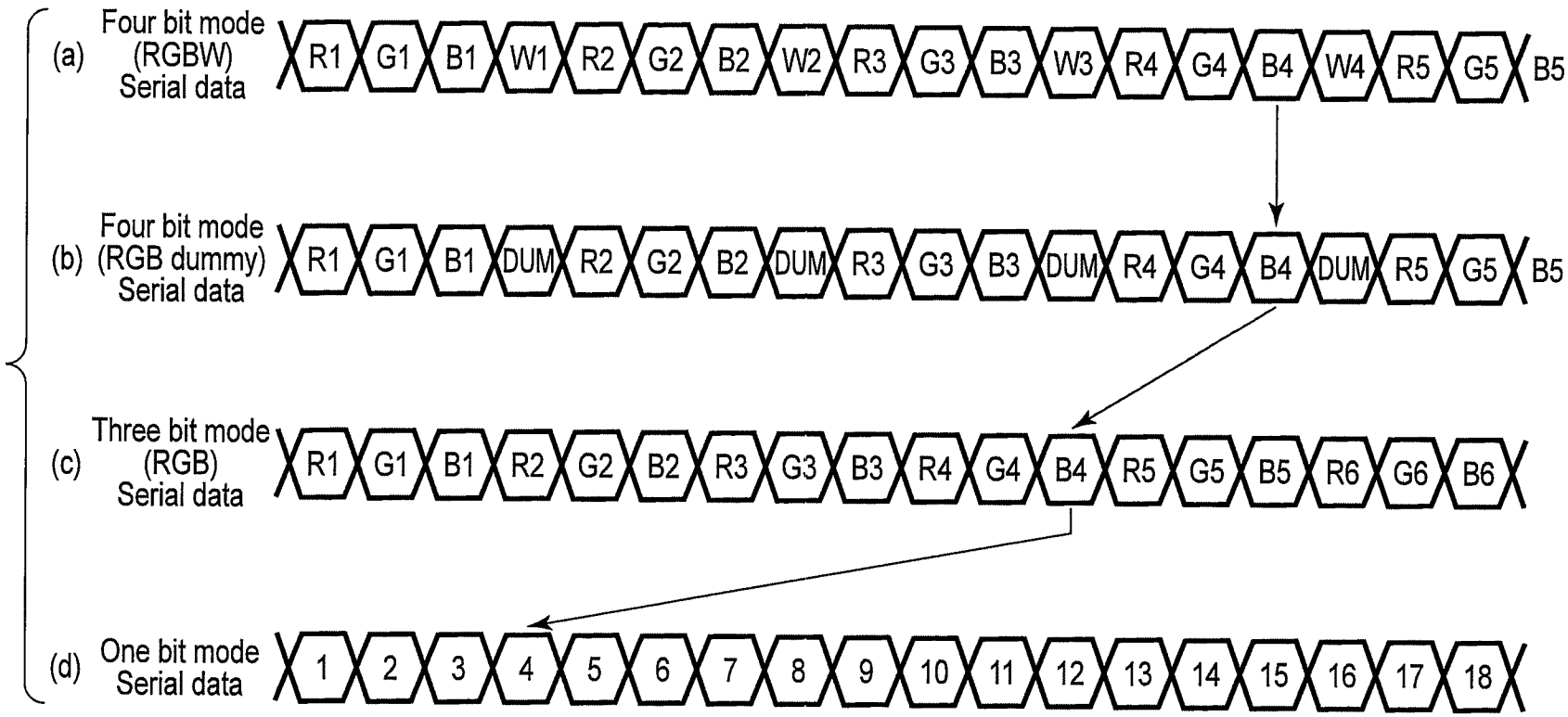
FIG. 12 is an explanatory diagram illustrating a serial data transfer rate when the signal supply circuit operates in each of the four bit mode, the three bit mode, and the one bit mode.

FIG. 12(*a*)-FIG. 12(*b*) illustrate serial data transfer rates in respective bit modes. Let us suppose that a video data piece in a register shifts by one step at a time for every clock. In the four bit mode, video data pieces R, G, B, and W constitute a single series of data. Accordingly, in the four bit mode, a total of sixteen clocks are needed in order to shift video data pieces R, G, B, and W for the amount of four cycles (FIG. 12(*a*)).

Even if video data pieces R, G, and B are supplied from an external device, the video data process circuit 125 may generate a dummy data piece as a video data piece W. In this case, the signal supply circuit 110 operates in the four bit mode. In this case, video data pieces R, G, B, and a dummy data piece (DUM) are included in a single series of data. Accordingly, in the four bit mode, a total of sixteen clocks are needed in order to shift video data pieces R, G, B, and DUM for the amount of four cycles (FIG. 12(*b*)).

In the three bit mode, video data pieces R, G, and B constitute a single series of data (there is not a video data piece W). Accordingly, in the three bit mode, a total of twelve clocks are needed in order to shift video data pieces R, G, and B for the amount of four cycles (FIG. 12(*c*)). At this time, the serial-parallel-conversion circuit 1110 is in such a switching state as illustrated in FIG. 8.

In the one bit mode, video data pieces R alone may be supplied as a single series of data, for instance. Accordingly, only four clocks may be sufficient to shift video data pieces R for the amount of four cycles in the one bit mode (FIG. 12(*d*)). At this time, the serial-parallel-conversion circuit 1110 is in such a switching state as illustrated in FIG. 9. The signal supply circuit 110 which belongs to the present embodiment and is used for a display device where a memory output is supplied to a sub-pixel has the above-mentioned characteristic function. The signal supply circuit 110 includes a mode control circuit 1103 which performs operation mode control.

The mode control circuit 1103 selectively changes the signal supply circuit 110 between a first mode and a second mode for differently supplying digital data to every memory. In the first mode, the signal supply circuit 110 receives from the outside first video data pieces corresponding to n sub-pixels, and supplies digital data pieces for the n sub-pixels to corresponding memories based on the first video data pieces. In the second mode, the signal supply circuit 110 receives from the outside second video data pieces corresponding to m sub-pixels fewer than n sub-pixels, and supplies digital data pieces for the m sub-pixels to corresponding memories based on the second video data pieces. Here, before the signal supply circuit 110 receives the first video data and the second video data, the mode control circuit 1103 receives mode control data. Moreover, the first video data pieces and the second video data pieces belong to serial data pieces. The signal supply circuit 110 comprises the parallel conversion circuit 1110 which parallel converts the serial data pieces to parallel digital data pieces corresponding to some of the sub-pixels, and the line data generation circuit 1120 which converts all the output data pieces of the parallel conversion section into digital data pieces suitable for the sub-pixels.

In the second mode, the line data generation circuit 1120 can generate such data pieces that are supplied among all the sub-pixels to only those sub-pixels that are used for white.

FIG. 13 illustrates the relation between a plurality of bit modes and control data pieces Cont_Sig supplied to the selector 1132 illustrated in FIG. 10. Control data pieces Cont_Sig include two bits M1 and M2, for example. In the case of the first four bit mode (R, G, B, W), (M1, M2)=(0, 0) stands. In the case of the second four bit mode (R, G, B, DUM), (M1, M2)=(0, 1) stands. In the case of the third bit mode (R, G, B), (M1, M2)=(1, 0) stands. In the case of the one bit mode (R or G or B or W), (M1, M2)=(1, 1) stands.

FIG. 14A illustrates the relation between distribution destinations (colors=color filters) and control data pieces Cont_Sig which are supplied to the distribution circuit 1134 illustrated in FIG. 10. Control data pieces Cont_Sig comprise a first three bit C1, a second three bit C2, and a third three bit C3, for example. The distribution circuit 1134 identifies the control data as black when (C1, C2, C3)=(0, 0, 0) stands. In this case, 0 is supplied to each of the output lines R, G, and B and W. The distribution circuit 1134 determines it as read when (C1, C2, C3)=(1, 0, 0) stands. In this case, 1, 0, 0, 0 are respectively supplied to the output lines R, G, B and W. The distribution circuit 1134 determines it as green when (C1, C2, C3)=(0, 1, 0) stands. In this case, 0, 1, 0, 0 are respectively supplied to the output lines R, G, B and W. The distribution circuit 1134 determines it as blue when (C1, C2, C3)=(0, 0, 1) stands. In this case, 0, 0, 1, 0 are respectively supplied to the output lines R, G, B and W. The distribution circuit 1134 identifies the control data as white when (C1, C2, C3)=(1, 1, 1) stands. In this case, 1, 1, 1, 1 are respectively supplied to the output lines R, G, B and W.

The latching circuits Lat12, Lat13, Lat14, Lat15, . . . as illustrated in FIG. 9 sequentially latch the respective data pieces which are distributed as mentioned above under the control of the register Reg11. The distribution circuit 1134 identifies the control data as white when (C1, C2, C3)=(1, 1, 1) stands. In this case, 1 is supplied to each of the output lines R, G, and B and W. The above structure makes it possible to drive four pixels using three bit data pieces R, G, and B.

When (C1, C2, C3)=(0, 1, 1) stands, it is determined as cyan. When (C1, C2, C3)=(1, 0, 1) stands, it is determined as magenta. When (C1, C2, C3)=(1, 1, 0) stands, it is determined as yellow. In this case, 0 is supplied to the output line W.

The above-mentioned explanation is premised on video data pieces being red (R), green (G), blue (B), and white (W). However, the idea of the present invention can be applied even when video data pieces are cyan, magenta, and yellow. That is, the idea of the present invention is also applicable to a display panel which comprises color filters divided into cyan, magenta, and yellow.

FIG. 14B illustrates an example of how the distribution circuit 1134 identifies control data when the control data is made of R, G, and B, and when the color filters of the display panel are divided into cyan, magenta, and yellow. The distribution circuit 1134 identifies the control data as white when (C1, C2, C3)=(1, 1, 1) stands. In this case, 1 is supplied to each of the output lines R, G, and B and W. The distribution circuit 1134 identifies the control data as cyan when (C1, C2, C3)=(0, 1, 1) stands. At this time, the output line to which a latching circuit supplying a data output to a cyan filter is connected is set to 1. The distribution circuit 1134 identifies the control data as magenta when (C1, C2, C3)=(1, 0, 1) stands. At this time, the output line to which a latching circuit supplying a data output to a magenta filter is connected is set to 1. The distribution circuit 1134 identifies the control data as yellow when (C1, C2, C3)=(1, 1, 0) stands. At this time, the output line to which a latching circuit supplying a data output to a yellow filter is connected is set to 1. The distribution circuit 1134 identifies the control data as black when (C1, C2, C3)=(0, 0, 0) stands. In this case, 0 is supplied to each of the output lines R, G, and B and W.

When white data (C1, C2, C3)=(1, 1, 1) is inputted, it is possible that any two selected from C1, C2, and C3 may be outputted as 1, or they may be outputted as 1 along with W.

Figure 15:
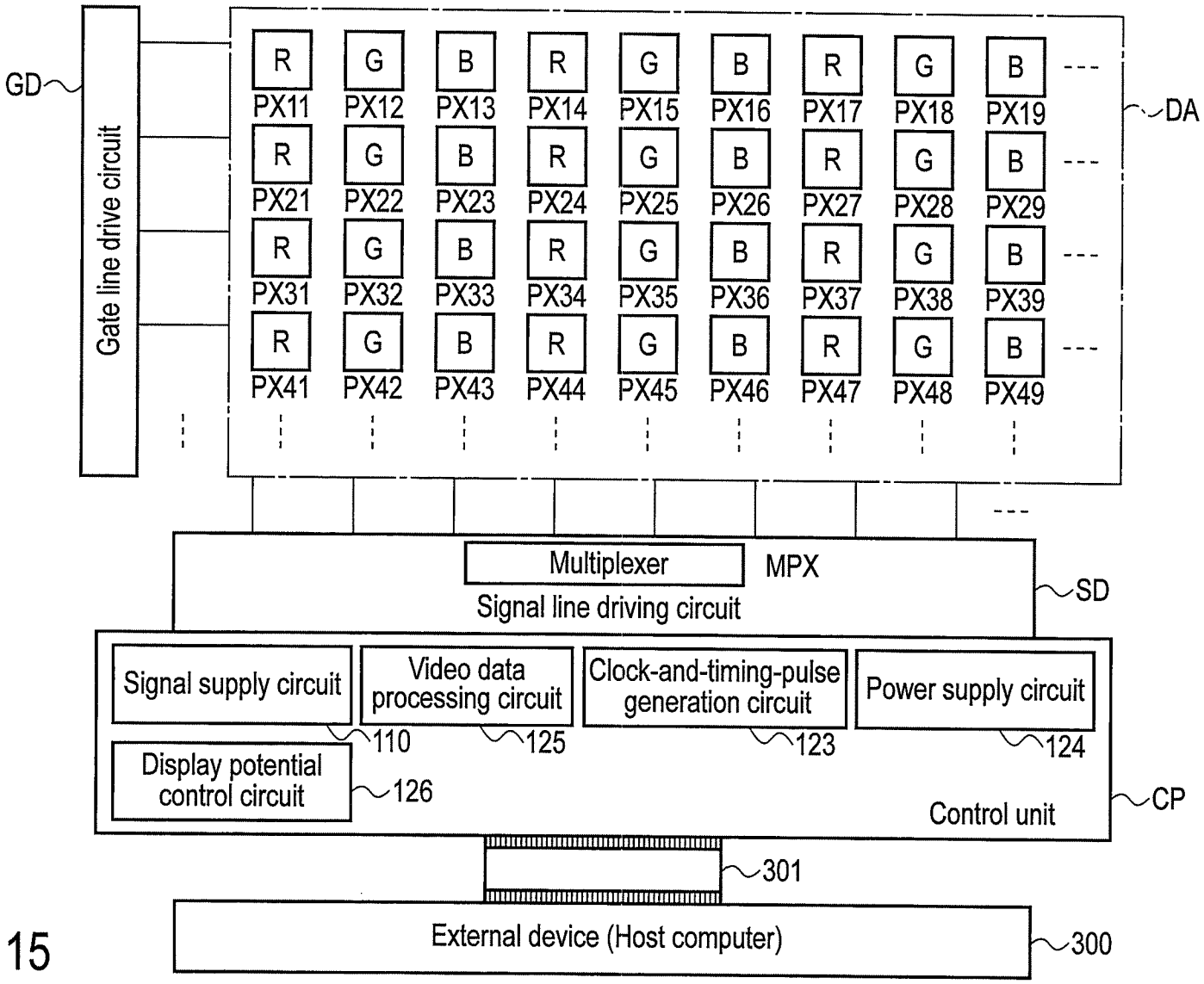
FIG. 15 illustrates an overall structure which a display device in another embodiment has and is different in arrangement of color filters from that is illustrated in FIG. 6.

The present invention is not limited to the above-described embodiment. The display device may have such a pixel structure as sub-pixels R, G, and B are vertically arranged as illustrated in FIG. 15. The remaining structures are the same as the remaining structures illustrated in FIG. 6. The present invention may also be applicable to such a display device that has a black (Bl) and white (Wh) monochrome mode in addition to an R, G, B color image display mode. Specifically, externally inputted control data shall specify either Bl or Wh in the monochrome mode. Then, the distribution circuit 1134 will output 1 to all the output lines R, G, and B (white display), if the control data is identified as Wh. On the other hand, the distribution circuit 1134 will output 0 to all the output lines R, G, and B (black display), if the control data is identified as Bl. Such a structure makes it possible to drive three sub-pixels by 1 bit in a monochrome mode, thereby achieving both improvement in data transfer rate and reduction in electric power consumption.

It should be noted that the embodiment has been explained on the assumption that the display device would use a normally black mode. However, the present invention can be also applied to such a display device that uses a normally white mode.

It has been hitherto explained that serial data is inputted into the input terminal 1103 of the signal supply circuit 110 illustrated in FIG. 7 through FIG. 9.

Generally, data which a digital device processes is treated in the unit of byte (for example, an 8-bit unit, a 16-bit unit, a 32-bit unit, etc.). Therefore, it is possible to divide the serial data inputted into the input terminal 1103 in the unit of 8 bits.

Figure 16:
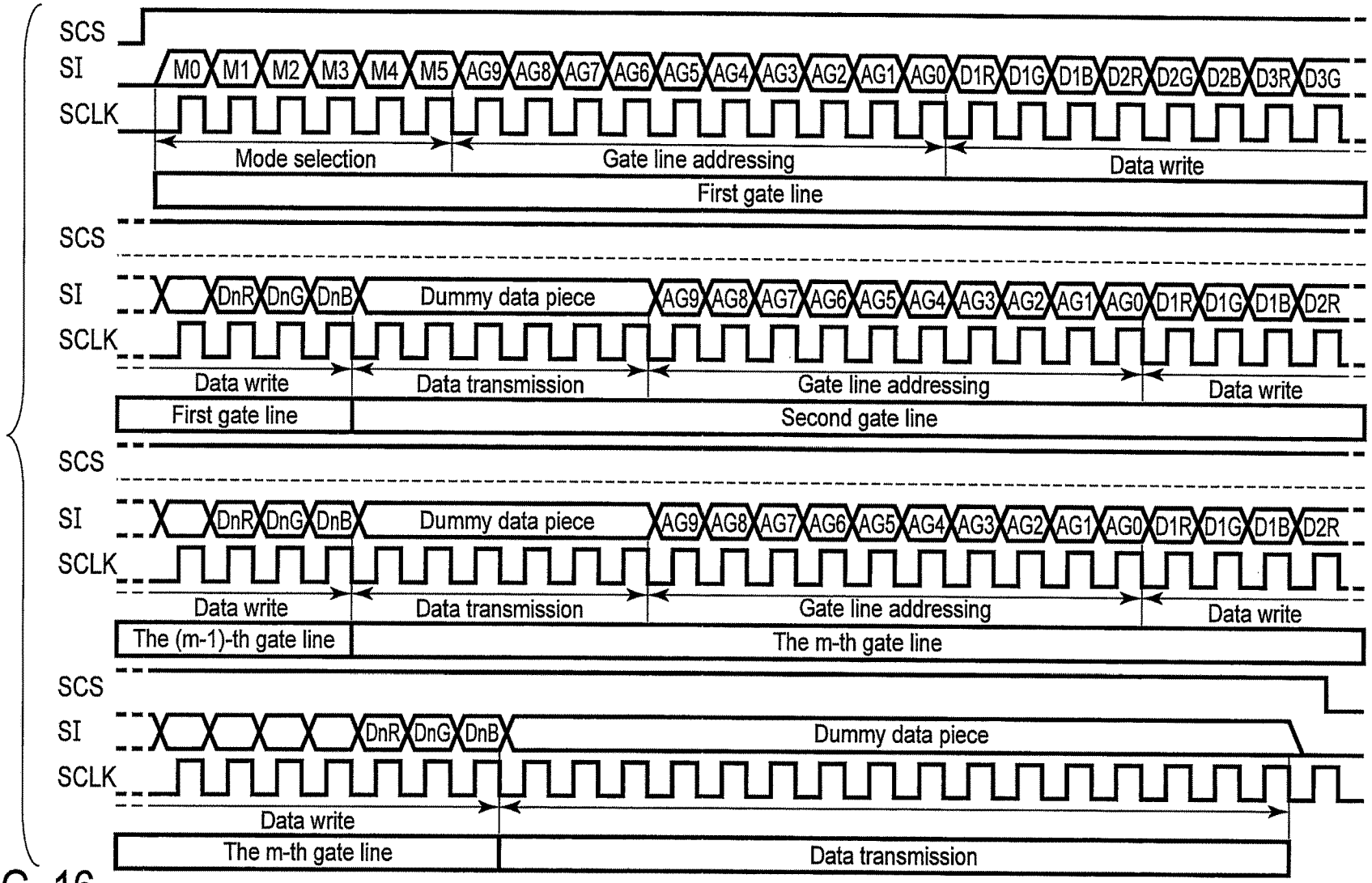
FIG. 16 illustrates an exemplary data arrangement for an exemplary eight bit unit serial transmission system.

FIG. 16 illustrates exemplary transmission formats for transmitting various kinds of serial data through a transmission line etc. Video data, control data, address information, dummy data, etc. are transmitted through a transmission line in accordance with a prescribed rule. SCS is a period designating signal which (may be called a synchronizing signal and) designates a period during which a certain amount of collected serial data is transmitted. SI is serial data, and includes mode control data (M0, M1 . . . M5), gate line addressing data (AG9, AG8, AG7, . . . , AG0), video data (D1R, D1G, D1B, . . . , DnB), dummy data ( . . . ), and others. Furthermore, it is possible that SI may further include a synchronizing clock, an error correction code, etc., in order to indicate a data boundary. SCLK is a serial clock (or a system clock), synchronizes with serial data, and can sample the serial data. The serial-data processing section receives the above serial data, and identifies serial data of an 8-bit unit, thereby separating the above serial data into video image data, control data, addressing data, etc. Video data is transmitted to the data conversion section (which may also be called a data control section) described later. Control data, addressing data, etc. are adjusted in output timing etc.

in the control unit CP, and are sent to the signal supply circuit 110, the gate line driving circuit GD, etc.

Figure 17:
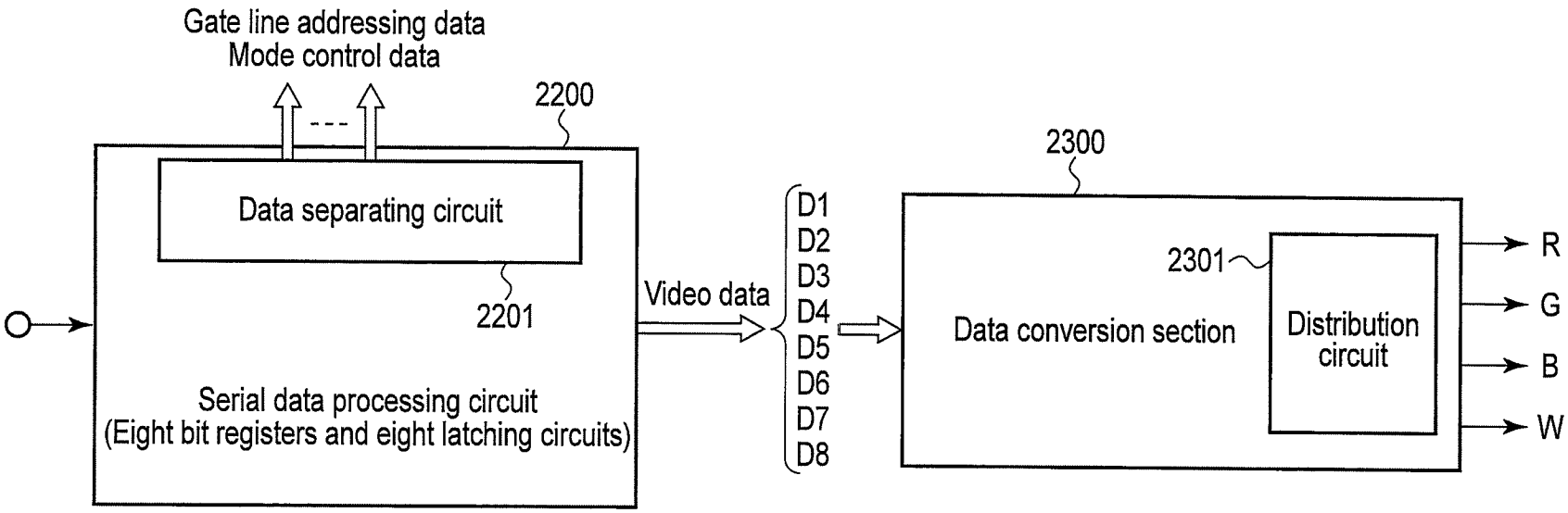
FIG. 17 is a block diagram illustrating (a signal supply circuit and a display device both in) another embodiment of the present invention adapted for data input complying with the eight bit unit serial transmission system.

FIG. 17 illustrates another exemplary signal supply circuit which receives and processes serial data illustrated in FIG. 16. Various kinds of signals required for the serial data processing circuit 2200 input into the input terminal 2103 as serial data. The serial data processing circuit 2200 identifies, for example, a pattern which a previously determined synchronizing pulse has. A serial clock SCLK and a synchronizing signal SCS are generated from the pattern identification result of a synchronizing pulse with the use of an internal clock.

The serial data processing circuit 2200 has a data separating circuit 2201 inside of it. The data separating circuit 2201 uses the synchronizing signal SCS and the serial clock SCLK to separate from the serial data mode control data (M0, M1, . . . , M5), gate line addressing data (AG9, AG8, AG7, . . . , AG0), video data (D1R, D1G, D1B, . . . , DnB), dummy data ( . . . ), etc.

Mode control data (M0, M1, . . . , M5) is data which specifies any one of a 4-bit mode, a 3-bit mode, a 1-bit mode, etc., and is used for determining a mode for each of the serial data processing circuit 2200 and the data conversion section 2300 and allowing them to process the video data. When video data is written in a sub-pixel, gate line addressing data (AG9, AG8, AG7, . . . , AG0) is used for making the gate line driving circuit GD (illustrated in FIG. 1) select one of the gate lines G (G1-Gn).

The serial data processing circuit 2200 converts the serially inputted video data into parallel data D1-D8 (dummy data may be included in the data depending on the mode), and outputs the parallel data D1-D8. The parallel data pieces D1-D8 are inputted into the data conversion section 2300, and are once latched. The data conversion section 2300 includes a distribution circuit 2301. The distribution circuit 2301 distributes the data pieces latched inside the data conversion section 2300 to suitable color sub-pixels, and outputs them to a latching circuit which holds a latter portion of each of the horizontal lines. That is, as illustrated in FIG. 7, FIG. 8, and FIG. 9, the distributed data pieces are supplied to a latching circuit group holding such an amount of sub-pixel data that covers one horizontal line.

Figure 18:
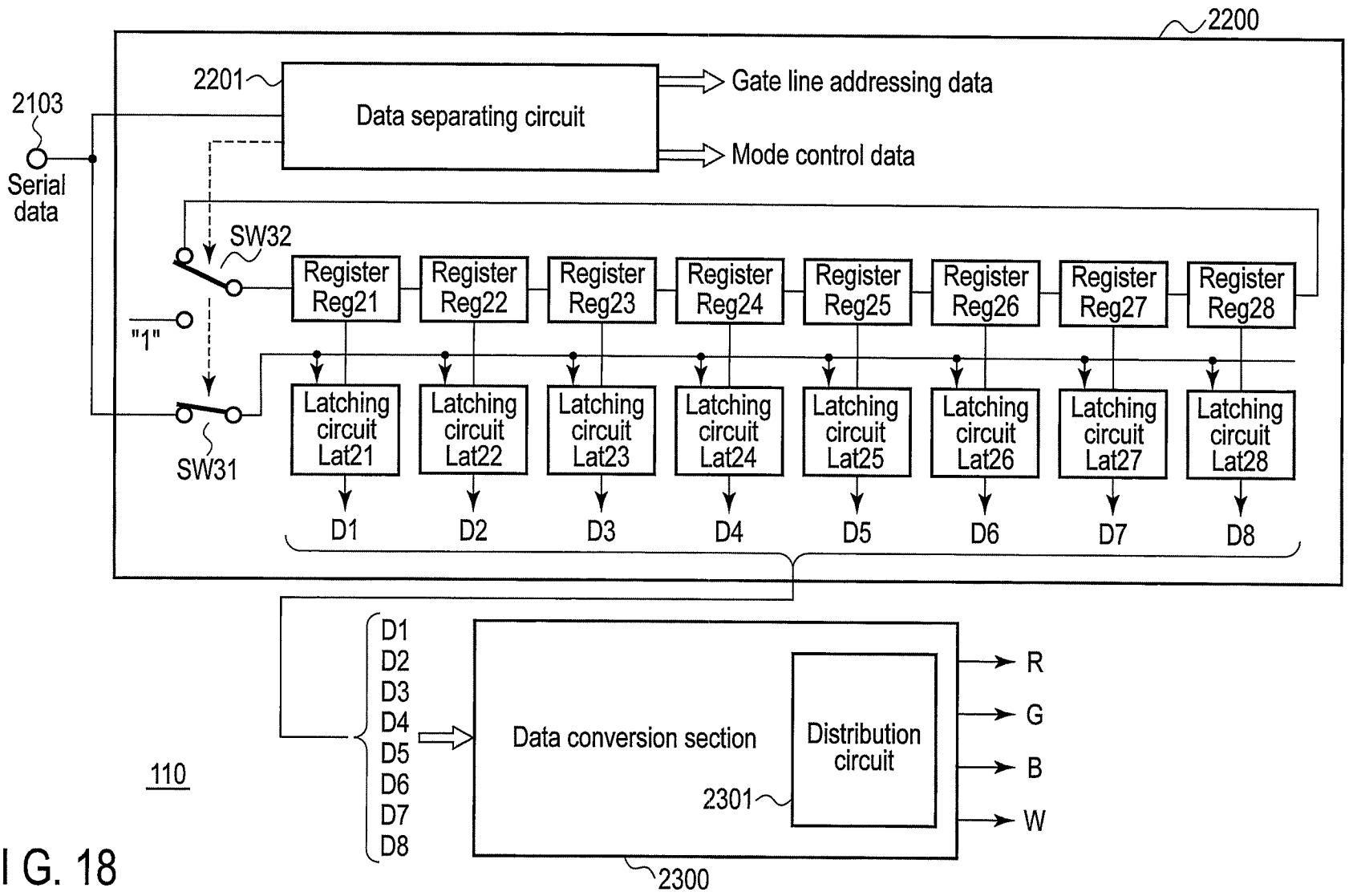
FIG. 18 specifically illustrates an exemplary serial-parallel-conversion circuit in the serial data processing circuit illustrated in FIG. 17.

FIG. 18 illustrates an exemplary serial-parallel-conversion circuit that is inside the serial data processing circuit 2200 illustrated in FIG. 17. The serial data processing circuit 2200 comprises eight registers Reg21-Reg28 which are serially connected with one another to process input data of an 8 bit unit, and cyclically generates a series of eight successive latching pulses. Moreover, the serial data processing circuit 2200 includes eight latching circuits Lat21-Lat28 to successively hold the respective eight successive serial data pieces (video data pieces). The eight latching circuits Lat21-Lat28 successively hold their respective video data pieces from the input terminal 2103 based on the respective latching pulses from the eight registers Reg21-Reg28. The data D1-D8 which the latching circuits Lat21-Lat28 respectively hold are inputted into the data conversion section 2300.

The input terminal 2103 is connected through a switch SW31 to a data input terminal of each of the latching circuits Lat21-Lat28. Input of video data pieces (D1R, D1G, D1B, . . . , DnB) illustrated in FIG. 16 to the input terminal 2103 causes the switch SW31 to turn on. A switch SW32 is used for inputting an initial value "1" into the register Reg21, and making all the registers to successively output a value "1" at every cycle of an 8-bit unit. Each of the registers Reg21-Reg28 is driven by a clock which is synchronous with a serial clock SCLK but is omitted in FIG. 18.

Figure 19:
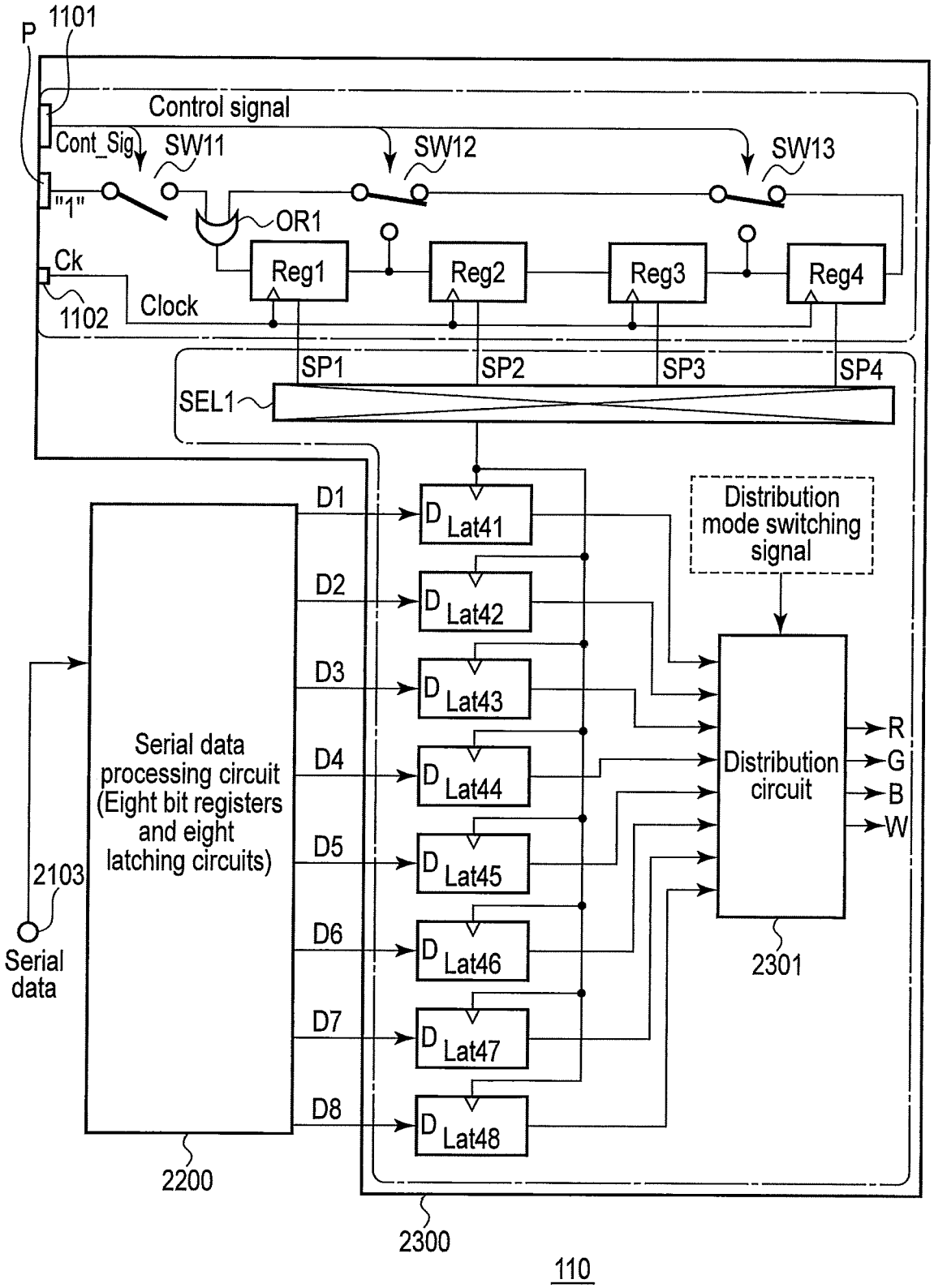
FIG. 19 specifically illustrates an exemplary data conversion section, which is schematically illustrated in FIG. 17 and is equivalent to a modified example of what is illustrated in FIG. 8.

FIG. 19 illustrates an exemplary internal structure which the data conversion section 2300 illustrated in FIG. 17 and FIG. 18 has. A serial data processing section 2200 supplies serial parallel converted data pieces D1-D8 to a data conversion section 2300. The data pieces D1-D8 may be held by the respective latching circuits Lat41-Lat48. A selector SEL selects latching pulses for the respective latching circuits Lat41-Lat48 from circulative sampling pulses (which may also be called latching pulses) SP1-SP4 respectively generated by the registers Reg1-Reg4. The circuits illustrated in FIG. 7-FIG. 9, each comprising the registers Reg1-Reg4, the switches SW11, SW12, SW13 and the OR circuit OR1, may be individually used for a circuit for generating the circulative pulses SP1-SP4. Data pieces which the latching circuits Lat41-Lat48 respectively hold are inputted into the distribution circuit 2301. The distribution circuit 2301 distributes data pieces latched by the latching circuits Lat41-Lat48 to the suitable collar sub-pixels, and outputs the data pieces to a latching circuit which is in a subsequent stage and keeps the data pieces until they accumulate as much as one row. That is, as illustrated in FIG. 7, FIG. 8, and FIG. 9, the distributed data pieces are supplied to a latching circuit group holding such an amount of sub-pixel data that covers one horizontal line.

Figure 20A:
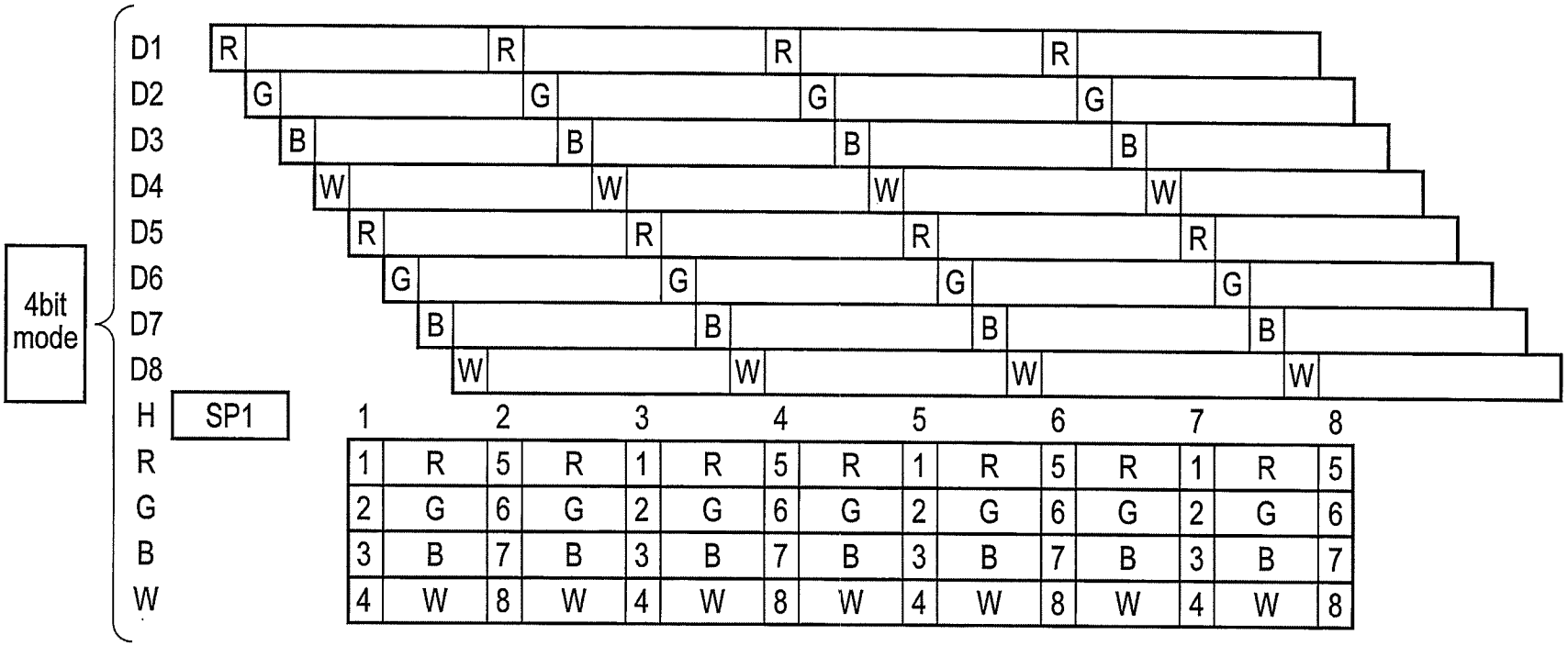
FIG. 20A is a timing diagram illustrating the relation between data piece latching timing and a latched data piece when the data conversion section illustrated in FIG. 19 operates in a four bit mode.

FIG. 20A illustrates how inputted video data pieces R, G, B, and W are exemplarily processed. At least one of the control unit CP, the signal supply circuit 110, the mode control circuit 1103, and the data separating circuit 2201 has a mode identification section, which identifies a mode control signal upon receiving the video data pieces and determines that the mode control signal is indicative of a four bit mode. Circulating sampling pulses SP1-SP4 are sequentially obtained from the registers Reg1-Reg4 in the four bit mode. At this moment, the switch SW13 selects the output of the register Reg4 and the switch SW12 selects the output of the switch SW3.

On the other hand, the selector SEL1 is made to select a sampling pulse SP1. Accordingly, the sampling pulse SP1 from the register Reg1 is used, and a latching pulse is supplied to the latching circuits Lat41-Lat48 at every four serial clocks SCLK. The serial data processing circuit 2200 outputs data pieces in order of D1, D2, D3, D4, D5, D6, D7, D8, D1, D2, D3, D4, D5, D6, D7, D8, . . . . Namely, eight successive data pieces D1, D2, D3, D4, D5, D6, D7, D8, are repeatedly outputted as a unit of eight bits from the serial data processing circuit 2200. The eight successive data pieces D1, D2, D3, D4, D5, D6, D7, D8 forming a unit of eight bits respectively denote colors R, G, B, W, R, G, B, W. Therefore, whenever the serially outputted data pieces are latched at every four real clocks SCLK, a set of four video data pieces R, G, B, W will be obtained in synchronization with the eight bit serial transmission.

Figure 20B:
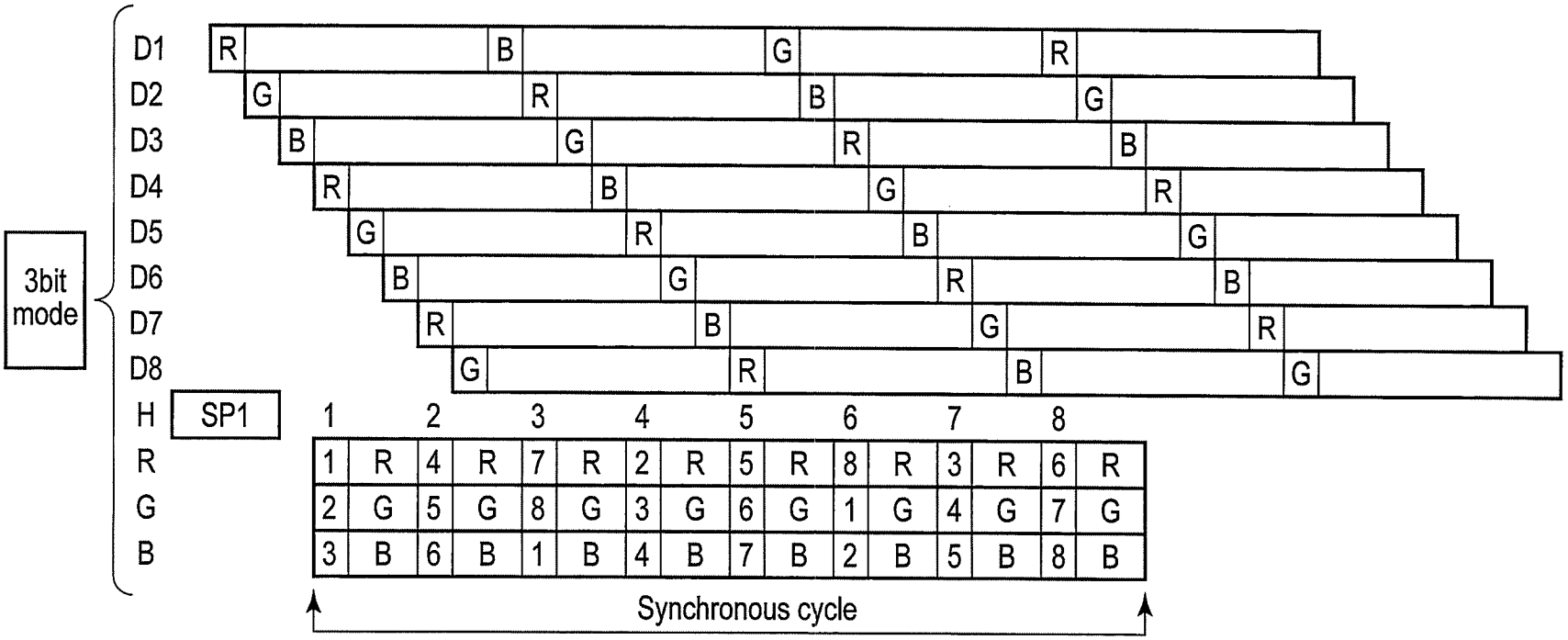
FIG. 20B is a timing diagram illustrating the relation between data piece latching timing and a latched data piece when the data conversion section illustrated in FIG. 19 operates in a three bit mode.

FIG. 20B illustrates how inputted video data pieces R, G, and B are exemplarily processed in a three bit mode. When such video data pieces are inputted, a mode identification section identifies a mode control signal, and determines that the mode control signal is indicative of a three bit mode. Circulating sampling pulses SP1-SP4 are sequentially obtained from the registers Reg1-Reg4 in the three bit mode. At this moment, the switch SW13 selects the output of the register Reg3 and the switch SW12 selects the output of the switch SW3.

On the other hand, the selector SEL1 is made to select a sampling pulse SP1. Accordingly, the sampling pulse SP1 from the register Reg1 is used, and a latching pulse is supplied to the latching circuits Lat41-Lat48 at every three serial clocks SCLK. The serial data processing circuit 2200 outputs data pieces in order of D1, D2, D3, D4, D5, D6, D7, D8, D1, D2, D3, D4, D5, D6, D7, D8, . . . . Namely, eight successive data pieces D1, D2, D3, D4, D5, D6, D7, D8, are repeatedly outputted in this order as a unit of eight bits from the serial data processing circuit 2200. The successively outputted recurrent data pieces D1, D2, D3, D4, D5, D6, D7, D8 are cyclically assigned with R, G, B in this order as their respective contents. Therefore, whenever the serially outputted data pieces are latched at every three real clocks SCLK, a set of three video data pieces R, G, B will be obtained. Here, it should be noted that the video data pieces which are serially transmitted in the unit of 8 bits and the data pieces D1, D2, D3, D4, D5, D6, D7, and D8 latched by the latching circuits Lat41-Lat48 are in the following relation. A transmission unit for the three video data pieces R, G, and B comprises 8 bits. Therefore, the least common multiple of the transmission unit and the three video data pieces will be a synchronous cycle for them, and will be 24. Accordingly, their synchronous cycle will be 24 bits (three 8-bit cycles). That is, a recurrent pattern of data pieces D1, D2, D3, D4, D5, D6, D7, D8 and a recurrent pattern of video data pieces R, G, B, R, G, B, R, G will coincide with each other for every 24 bit cycle.

Accordingly, a 24-bit cycle is taken into consideration at the time of the 3-bit mode, and the mode which successively distributes the data pieces D1, D2, D3, D4, D5, D6, D7, and D8 among the output terminals R, G, and B is used as an operation mode for the data distribution circuit 2301. In the example of FIG. 20B, the data pieces are selectively supplied to an R output terminal in order of D1, D4, D7, D2, D5, D8, D3, D6, D1, . . . , for example.

Figure 20C:
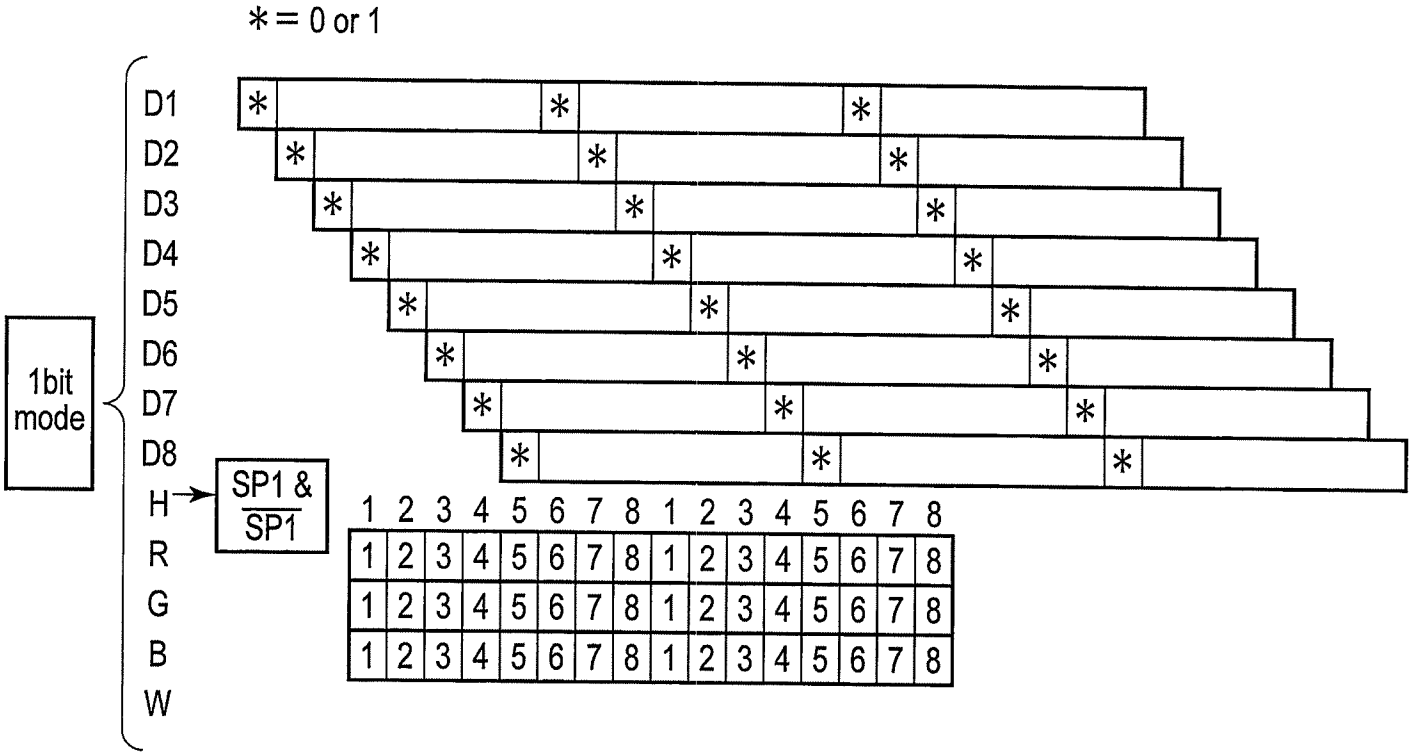
FIG. 20C is a timing diagram illustrating the relation between data piece latching timing and a latched data piece when the data conversion section illustrated in FIG. 19 operates in a one bit mode.

FIG. 20C illustrates how an inputted video data piece * (*=any one of R, G, B, W, and a dummy data piece) exemplarily processed in a one bit mode. When such a video data piece is inputted, a mode identification section identifies a mode control signal, and determines that the mode control signal is indicative of a one bit mode. A sampling pulse SP1 from the register Reg1 and its reverse pulse/SP1 are used in the one bit mode. At this moment, the switch SW12 selects the output of the register Reg1. At this time, the sampling pulse SP of the register Reg1 repeats "1," "0," "1," "0," . . . .

In the one bit mode, it is possible that any one of the data pieces D1, D2, D3, D4, D5, D6, D7, and D8 that are outputted from the serial data processing circuit 2200 may be "1." However, when the data piece D1 is used as a transmission data piece indicative of "1," for example, the rest of the data pieces will be determined to indicate "0." This makes the distribution circuit 2301 select the data piece D1. The distribution circuit 2301 simultaneously outputs "0" or "1" to all the output terminals R, G, and B in response to the white mode or the black mode. Alternatively, when there is color specifying information even in the one bit mode, the distribution circuit 2301 outputs "1" to any one of the output terminals R, G, B according to the color specifying information.

Figure 21:
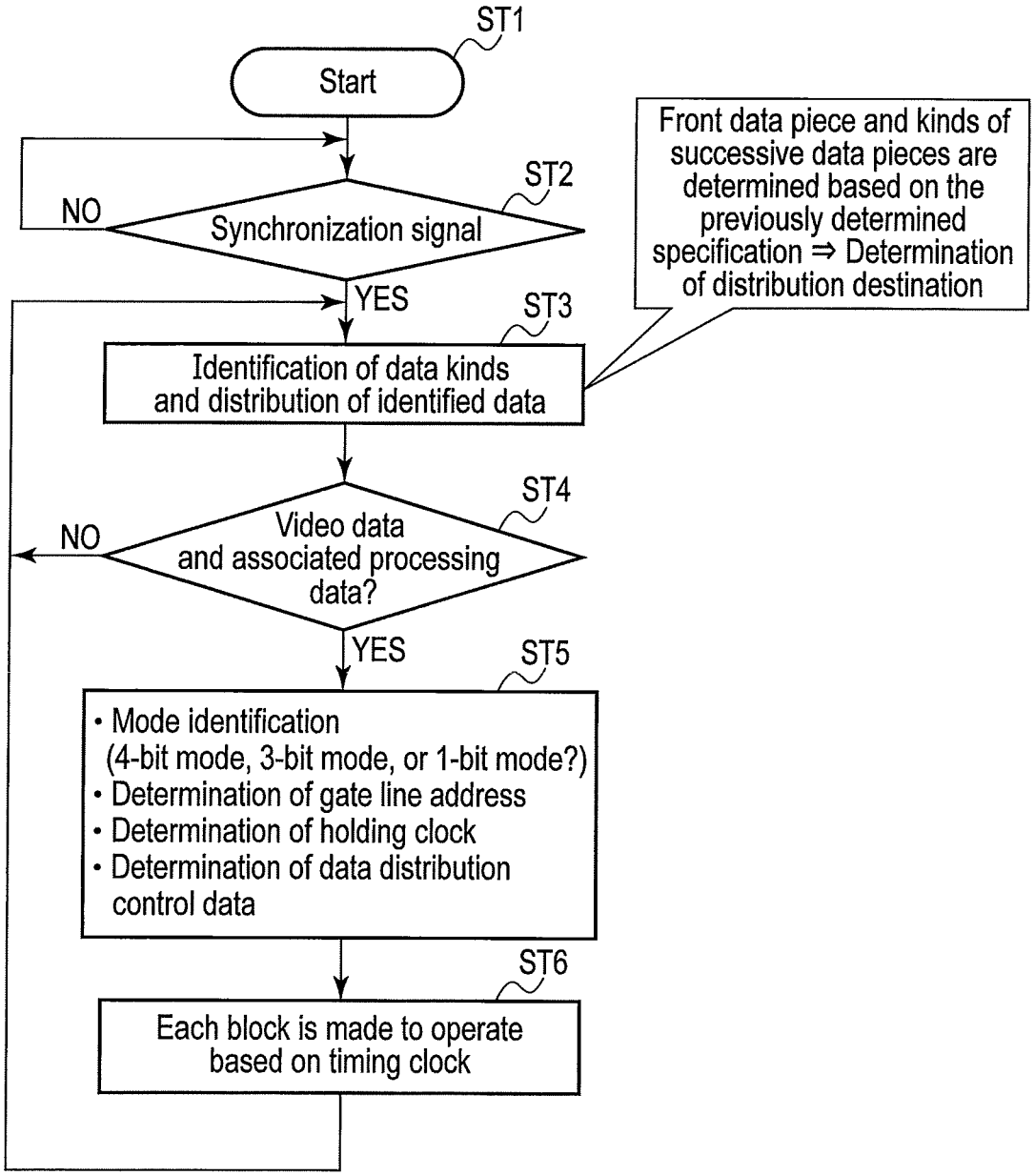
FIG. 21 briefly illustrates an operation flow of the signal supply circuit illustrated in FIG. 17 and FIG. 18.

FIG. 21 briefly illustrates an operation flow of the signal supply circuit illustrated in FIG. 17, FIG. 18 and FIG. 19. First of all, a mode identification section will detect a synchronizing signal and will be in a synchronizing state for 8-bit unit serial data (ST1, ST2). In the synchronizing state, the serial data processing circuit 2200 identifies the kind of each of the input data pieces and distributes the input data pieces based on a data array which is previously determined by the specification or the like (ST3). Moreover, the data separation section 2201 or the mode identification section identifies video data pieces and processing data pieces associated with the video data pieces. The associated processing data pieces are mode control data pieces, gate addressing data pieces, etc., which have been explained with reference to FIG. 16 (ST4). After the mode identification section has identified a mode, any one of the 4-bit mode, the 3-bit mode, or the 1-bit mode is set (ST5). And operation of each block is executed based on a timing clock (ST6).

Figure 22:
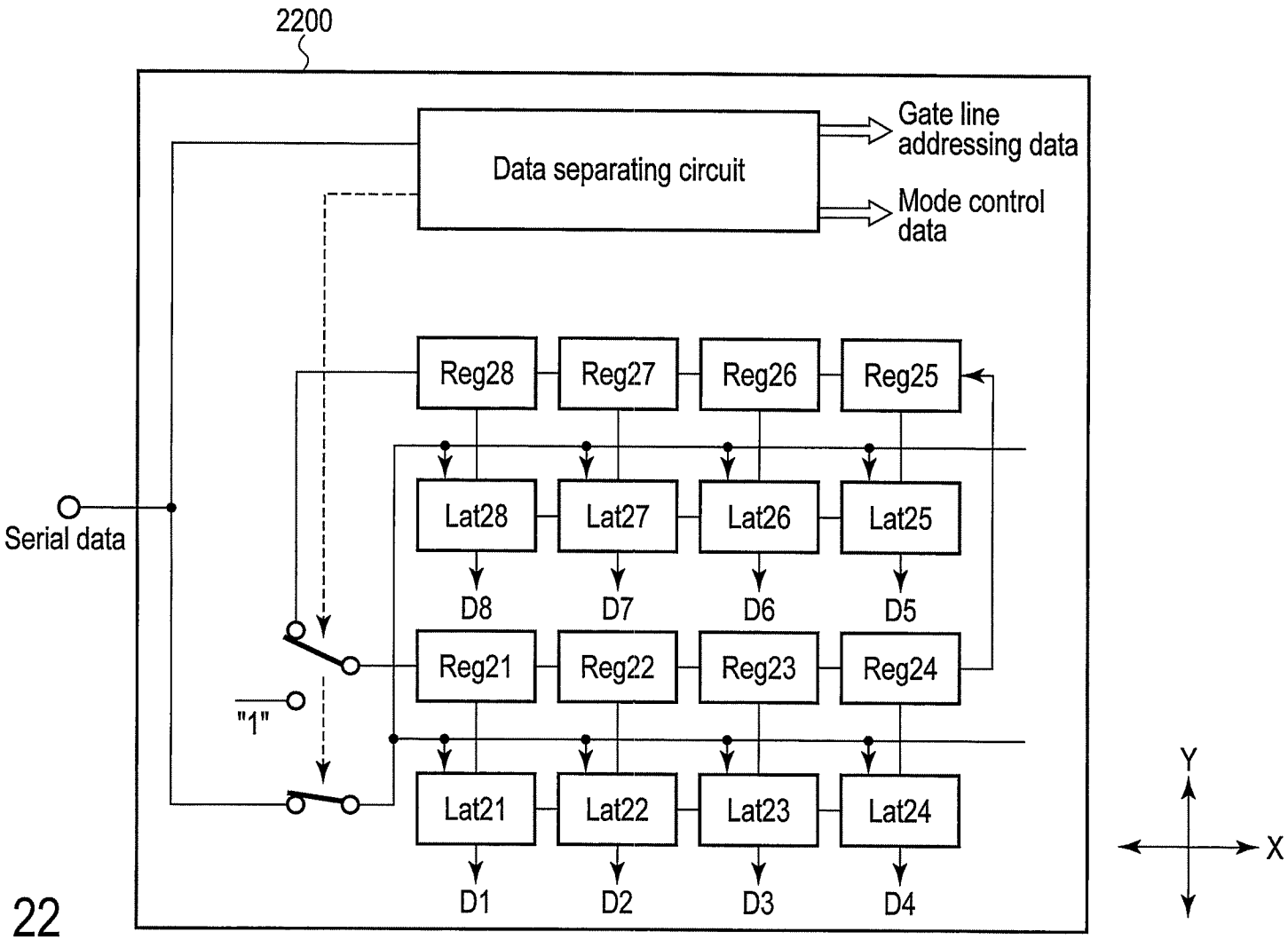
FIG. 22 illustrates another exemplary structure which the serial data processing circuit illustrated in FIG. 18 has.

The present invention is not limited to the above-described embodiments. FIG. 22 illustrates yet another embodiment. In the embodiment illustrated in FIG. 18, the registers Reg21-Reg28 and the latching circuits Lat21-Lat28 are arranged along the gate lines (along the X-axis) in the signal supply circuit 110. However, it may be possible to arrange the registers and the latches as illustrated in FIG. 22 if an area, which the control unit CP has, has restriction along the X-axis, along which the registers and the latches are arranged, or has much room along the Y-axis, along which signal lines extend perpendicularly crossing the rows of the registers and the rows of the latches. That is, it is possible that the registers may be arranged to form two rows and the latching circuits may be arranged to form two rows. It should be noted that elements identical to those in the embodiment illustrated in FIG. 18 will be denoted by the same reference numbers, and their detailed explanations will be omitted.

Figure 23:
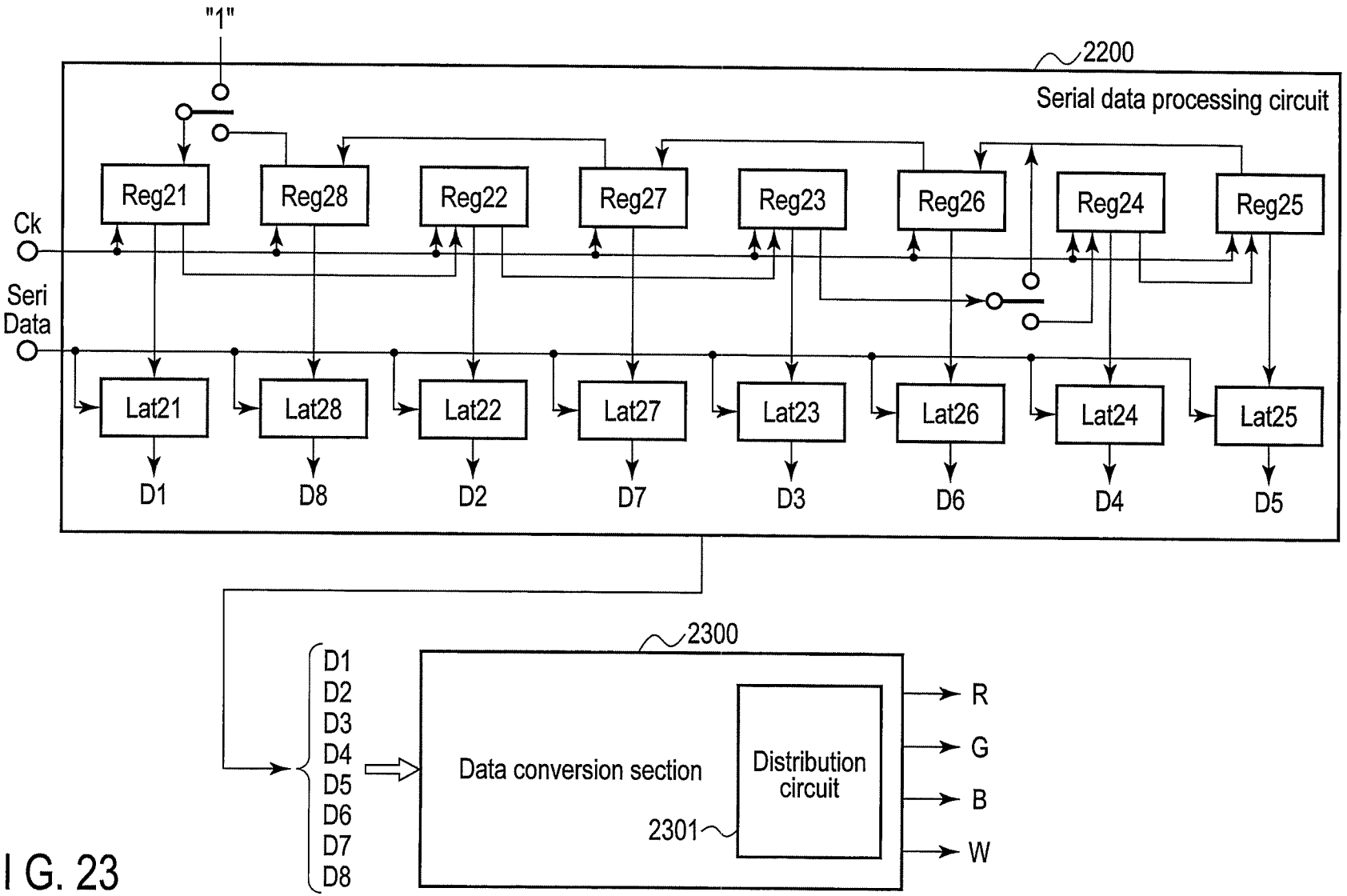
FIG. 23 illustrates still another exemplary structure which the serial data processing circuit illustrated in FIG. 18 has.

The present invention is not limited to the above-described embodiments. FIG. 23 illustrates yet another embodiment. The serial data processing circuit 2200 in the embodiment illustrated in FIG. 18 has registers Reg21-Reg28 connected in series with one another. The series circuit does not allow any bit to return wile it is in the process of transmission. However, the register series circuit of FIG. 23 has a switch SW41 between a register Reg23 and a register Reg24. It is the switch SW41 that allows the register series circuit to transmit the output of the register Reg23 to either the register Reg26 or the register Reg24. The register series circuit of FIG. 23 has a switch SW42 to determine whether the output of the register Reg28 in the last stage should be fed back to the register Reg21 in the first stage or an initial value "1" should be inputted into the register Reg21. A status output ("1" or "0") which is outputted from any one of the registers Reg21-Reg28 is supplied as a latching pulse to a latching pulse input terminal which a corresponding one of the latching circuits Lat21-Lat28 has. The latching circuits Lat21-Lat28 latch the respective data pieces, which have been serially inputted, at timing when a latching pulse is supplied, and output the latched data pieces as data pieces D1-D8.

The above structure makes it possible to switch between an eight-stage route and a six-stage route by means of the two switches when the register series circuit transmits data "1". Namely, a data piece "1" passes through the registers Reg21, Rge22, Reg23, Reg24, Reg25, Reg26, Reg27, and Reg28 in the eight-stage route, whereas a data piece "1" passes through the registers Reg21, Rge22, Reg23, Reg26, Reg27, and Reg28 in the six-stage route. Since 8 is a multiple of 4, it may be convenient to use an eight-stage route in a 4-bit mode. Since 6 is a multiple of 3, it may be convenient to use a six-stage route in a 3-bit mode.

Figure 24A:
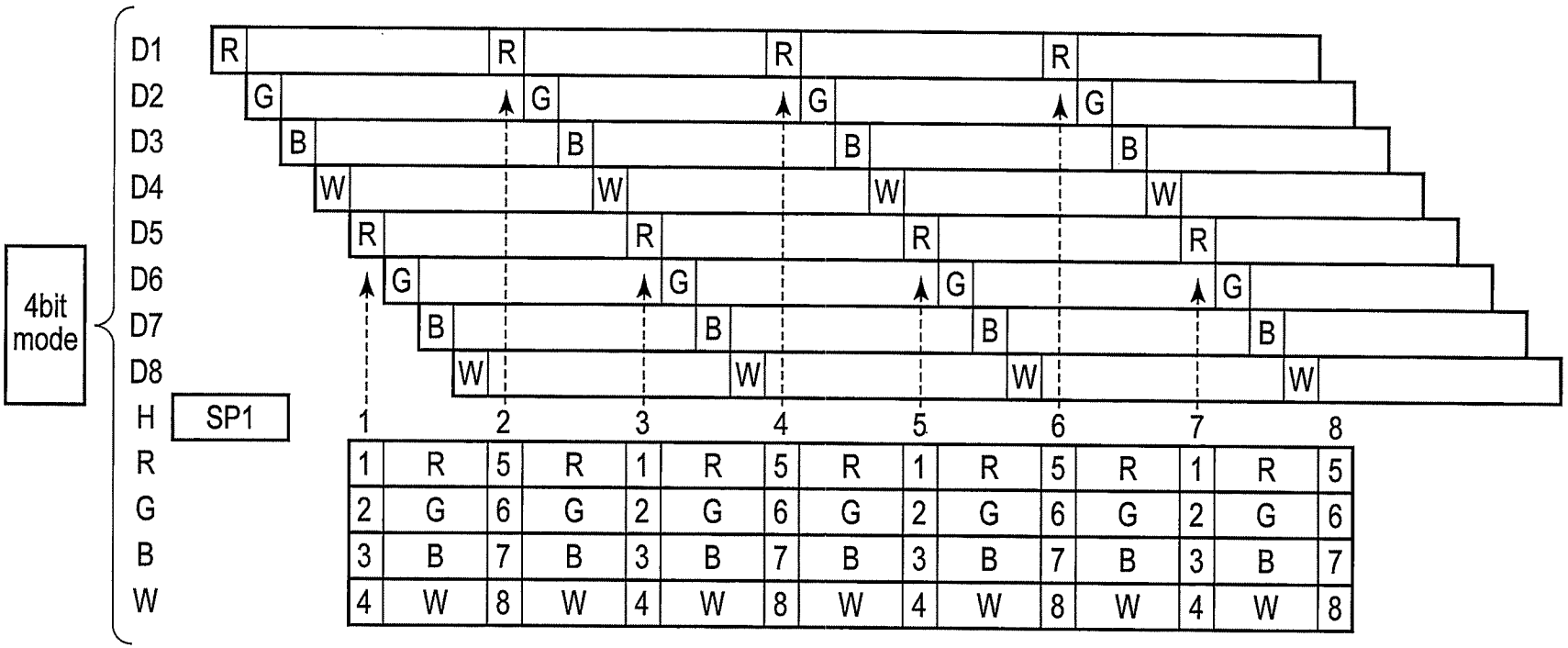
FIG. 24A is a timing diagram illustrating the relation between data piece latching timing and a latched data piece when the data conversion section illustrated in FIG. 23 operates in a four bit mode (or a one bit mode).

FIG. 24A illustrates a relation among data pieces D1-D8 outputted from the respective latching circuits Lat21-Lat28, the moments when the data conversion section 2300 latches the data pieces, and the latched data pieces, when the signal supply circuit 110 illustrated in FIG. 3 is operating in a 4-bit basic mode (which may also be called an 8-bit mode). First four data pieces D1-D4 are latched by a first single latch, and next four data pieces D5-D8 are latched by a next single latch. Further four data pieces D1-D4 are latched by a further next single latch, and subsequent four data pieces D5-D8 are latched by a sill further single latch. These actions are repeated. Every time video data pieces R, G, B, W (or a dummy data piece instead of W) are inputted, a 4-bit mode is used.

Figure 24B:
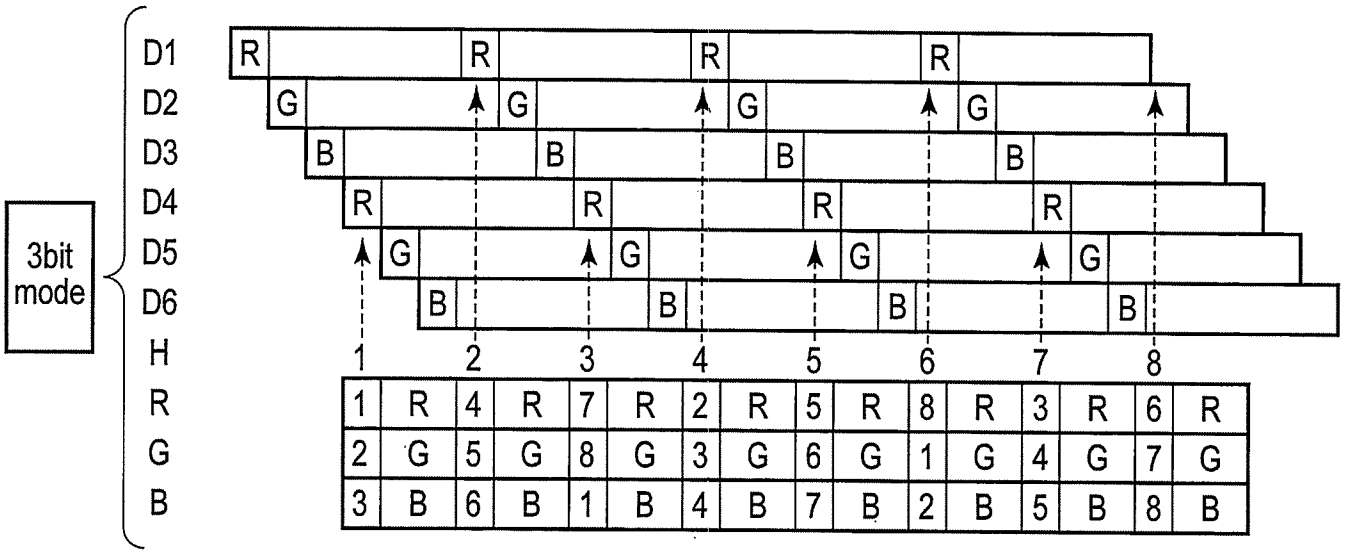
FIG. 24B is a timing diagram illustrating the relation between data piece latching timing and a latched data piece when the data conversion section illustrated in FIG. 23 operates in a three bit mode.

FIG. 24B illustrates a relation among data pieces D1-D6 outputted from the respective latching circuits Lat21-Lat26, the moments when the data conversion section 2300 latches the data pieces, and the latched data pieces, when the signal supply circuit 110 illustrated in FIG. 23 is operating in a 3-bit basic mode (which may also be called an 6-bit mode). First three data pieces D1-D3 are latched by a first single latch, and next three data pieces D4-D6 are latched by a next single latch. Further three data pieces D1-D3 are latched by a further next single latch, and subsequent three data pieces D4-D6 are latched by a sill further single latch. These actions are repeated. Every time video data pieces R, G, B are inputted, a 3-bit mode is used.

When the serial data processing circuit operates in a 1-bit mode, the distribution circuit 2301 automatically begins to output any one of R, G, B, W, or a combination of at least two of R, G, B, W according to a control signal (which also includes a distribution mode switching signal and color specifying information), for example. It may be possible at this time to stop the registers Reg21-Reg28 and the latching circuits Lat21-Lat28 for cutting down the electric power consumption.

The above embodiment makes it simple to control the distribution process executed by the distribution circuit 2301.

Figure 25:
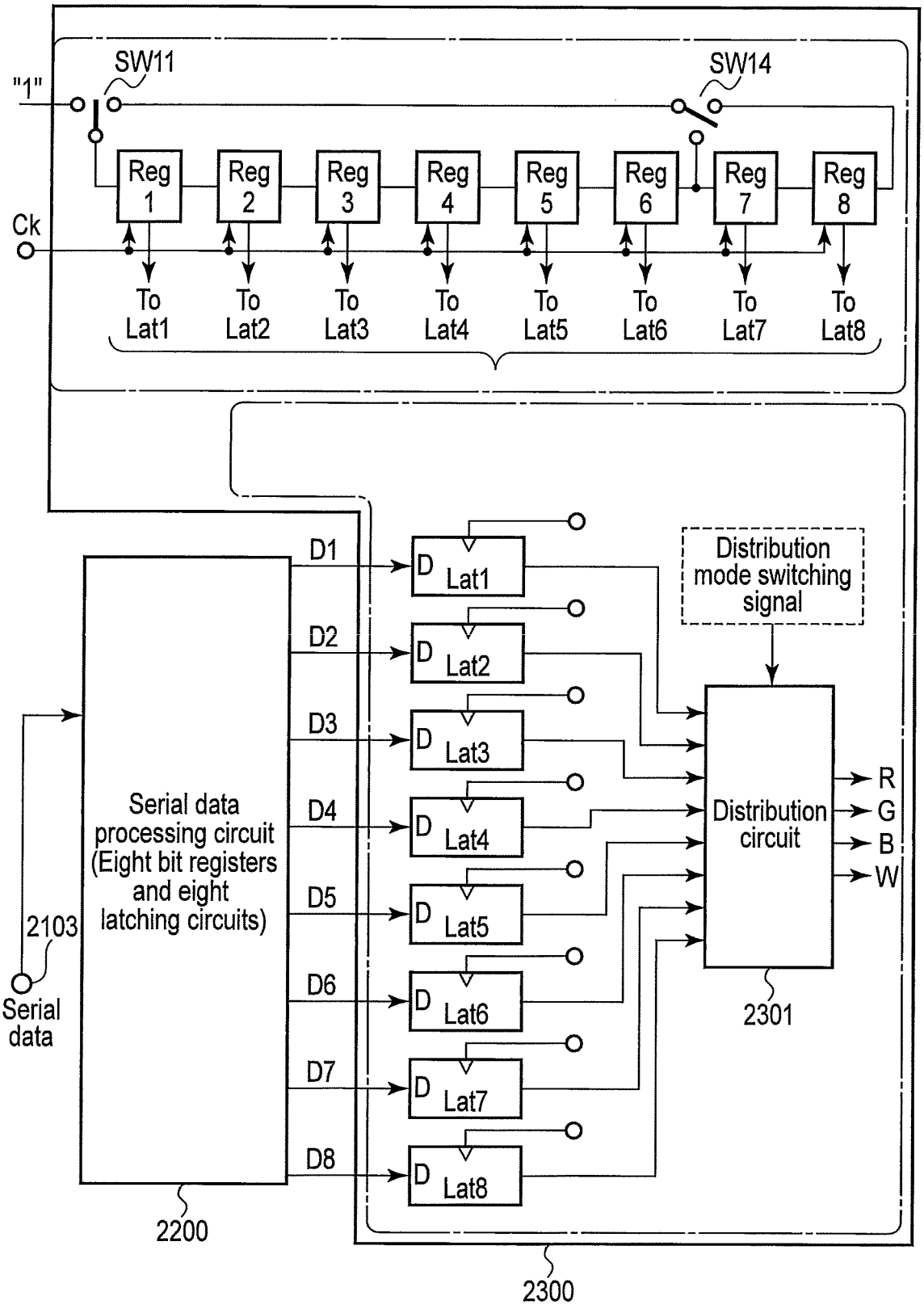
FIG. 25 illustrates still another embodiment of the data conversion section.

FIG. 25 illustrates still another embodiment of the data conversion section 2300. The data conversion section 2300 illustrated in FIG. 19 has four registers to generate four sampling pulses (which may be called latching pulses) SP1-SP4. However, a sampling pulse generation circuit may comprise eight registers Reg1-Reg8, as illustrated in FIG. 25. In this case, it is preferable as has been explained in the former embodiment that a suitable sampling clock is generated according to any one of the 4-bit mode, the 3-bit mode, and the 1-bit mode. Consequently, the switches SW11 and SW14 are provided in this sampling pulse generation circuit. The switch SW14 selects either an output which the register Reg7 provides or an output which the register Reg8 provides. And the switch SW11 selects either an output which the switch SW14 provides or the input terminal for taking in a data piece "1" at the time of initial setting.

Sampling pulses (latching pulses) outputted from the respective registers Reg1-register Reg8 are supplied to the latching pulse input terminals of the respective latching circuits Lat1-Lat8. Each of the video data pieces D1-D8 which the serial data processing section 2200 has extracted is inputted into a corresponding one of those data input terminals that the respective latching circuits Lat1-Lat8 has.

When the above sampling pulse generation circuit is brought in a 4-bit basic mode (which may be also called an 8-bit mode), it causes the switch SW14 to select the output of the register Reg8 and the switch SW11 to select the output of the switch SW14.

At this time, the relation among the output data pieces D1-D8 from the respective latching circuits Lat1-Lat8, the moments when the data conversion section 2300 latches the data pieces, and the latched data pieces is the same as the relation illustrated in FIG. 24A. First four data pieces D1-D4 are latched by a first single latch, and next four data pieces D5-D8 are latched by a next single latch. Further four data pieces D1-D4 are latched by a further next single latch, and subsequent four data pieces D5-D8 are latched by a sill further single latch. These actions are repeated. Every time video data pieces R, G, B, W (or a dummy data piece instead of W) are inputted, a 4-bit mode is used.

When the above sampling pulse generation circuit is brought in a 3-bit basic mode (which may be also called a 6-bit mode), it causes the switch SW14 to select the output of the register Reg6 and the switch SW11 to select the output of the switch SW14.

At this time, the relation among the output data pieces D1-D8 from the respective latching circuits Lat1-Lat8, the moments when the data conversion section 2300 latches the data pieces, and the latched data pieces is the same as the relation illustrated in FIG. 24A. First three data pieces D1-D3 are latched by a first single latch, and next three data pieces D4-D6 are latched by a next single latch. Further three data pieces D1-D3 are latched by a further next single latch, and subsequent three data pieces D4-D6 are latched by a sill further single latch. These actions are repeated. Every time video data pieces R, G, B are inputted, a 3-bit mode is used.

When the signal supply circuit 110 operates in a 1-bit mode, the distribution circuit 2301 automatically begins to output any one of R, G, B, W, or a combination of at least two of R, G, B, W according to a control signal (which also includes a distribution mode switching signal and color specifying information), for example. It may be possible at this time to stop the data conversion section 2300 for cutting down the electric power consumption.

The above embodiment makes it simple to control the distribution process executed by the distribution circuit 2301.

Figure 26:
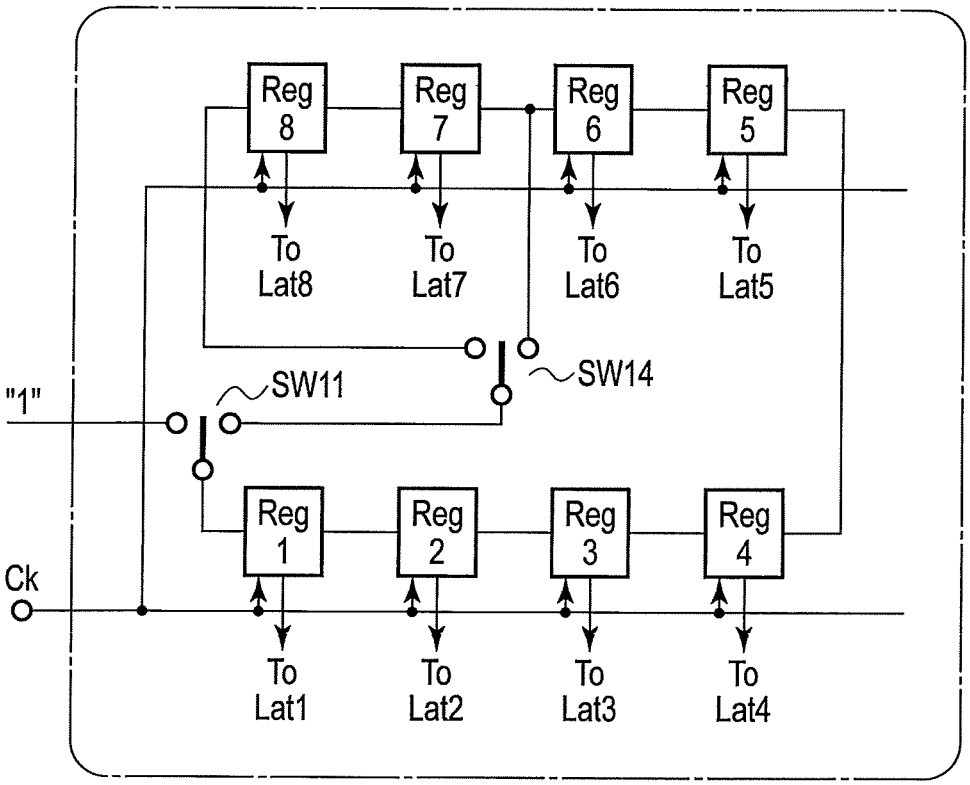
FIG. 26 illustrates still another embodiment of the latching pulse generation section illustrated in FIG. 25.

FIG. 26 illustrates another embodiment of the above-mentioned sampling pulse generation circuit. In the embodiment illustrated in FIG. 25, the registers Reg1-Reg8 are linearly arranged along the X-axis. For example, eight registers Reg1-Reg8 may be divided into two groups, each comprising four registers, and may be arranged in such a manner that the two groups form two rows as illustrated in FIG. 26. In the following descriptions, those circuits that are the same as those illustrated in FIG. 25 are denoted by the same reference numerals and their explanations are omitted. This arrangement pattern makes it possible to shorten the length of the X-axis.

As has been described above, increase in data transfer rate and reduction in electric power consumption will be achieved by devising a new method of supplying data to a display panel according to the performance of an external device. The above-mentioned embodiments may be applicable to both a reflection type display device, in which pixel electrodes reflect external light, and a transmission type display device which has a back light.

(1) As described above, a signal supply circuit in any one of the above described embodiments has two modes, one being a first mode and the other a second mode, and supplies digital data pieces to sub-pixels fundamentally arranged in a matrix to cover a display panel.

The signal supply circuit receives externally supplied first video data pieces corresponding to n sub-pixels in the first mode, prepares digital data pieces for the n sub-pixels based on the first video data pieces, and supplies them to the display panel.

The signal supply circuit receives externally supplied second video data pieces corresponding to m sub-pixels fewer than n sub-pixels in the second mode, prepares digital data pieces for the m sub-pixels based on the second video data pieces, and supplies them to the display panel.

(2) The first and the second video data pieces belong to serial data. The signal supply circuit described in the item (1) has a register series circuit in which registers are connected in series with one another to generate a latching pulse for changing the serial data into parallel data (See, for example, FIG. 7, FIG. 8, FIG. 9, FIG. 18, FIG. 19, FIG. 22, FIG. 23, FIG. 25, FIG. 26).

(3) A register series circuit described in the item (2) is provided with a switch, which changes between a first route that returns an output, which a register at a last stage provides, to a data input terminal, which a register at a first stage has, and a second route that returns an output, which a register at a stage before the last stage provides, to the data input terminal of the register at the first stage in order to selectively obtain a latching pulse for the first mode and a latching pulse for the second mode (See, for example, FIG. 7, FIG. 8, FIG. 9, FIG. 19, FIG. 22, FIG. 23, FIG. 25, FIG. 26).

(4) The register series circuit described in the item (2) supplies latching pulses to the respective latching pulse input terminals of the latching circuits which latch their respective serial data pieces (FIGS. 7-9, FIG. 18, FIG. 19, FIG. 23, FIG. 25, FIG. 26).

(5) The register series circuit described in the item (2) is provided in a serial data processing circuit which converts into parallel data serial data inputted in the unit of 8 bits (See, for example, FIG. 18, FIG. 22, FIG. 23).

(6) The register series circuit described in the item (2) is used in a latching pulse generating circuit which generates latching pulses for latching arbitrary data after the serial data having been inputted in the unit of 8 bits has been changed into parallel data (FIG. 19, FIG. 25, FIG. 26).

(7) The serial data, which is inputted in the unit of 8 bits and is described in the item (5) or the item (6), further includes addressing data and mode control data other than video data.

(8) The signal supply circuit described in the item (7) changes between the first mode and the second mode based on mode control data.

(9) The serial data described in the item (1) includes either video data pieces R, G, B, W or video data pieces R, G, B.

(10) The signal supply circuit described in the item (1) further includes a circuit which automatically generates dummy data.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions. Furthermore, the components of claims are in the category of the embodiments even if the components are expressed separately, even if the components are expressed in association with each other, or even if the components are expressed in combination with each other. It should be noted that a device of the present invention may be expressed as a control logic, a program including instructions which cause a computer to operate, or a recording medium which holds the instructions and which a computer can read.

What is claimed is:

1. A display device comprising:

a display panel including a plurality of sub-pixels; and a signal supply circuit supplying parallel data to the display panel, wherein the plurality of n sub-pixels have memories, respectively, the signal supply circuit, in a first mode, receives first serial data for n sub-pixels, and supplies n-bit parallel data to the respective memories of the n sub-pixels based on the first serial data, and in a second mode, receives second serial data for m sub-pixels fewer than the n sub-pixels, and outputs n-bit parallel data to the respective memories of the n sub-pixels based on the second serial data.

2. The display device of claim 1, further comprising a mode control circuit, wherein the mode control circuit controls an operation mode between the first mode and the second mode.

3. The display device of claim 2, wherein the signal supply circuit includes a parallel conversion section, and the parallel conversion section converts the first and second serial data to the parallel data.

4. The display device of claim 2, the signal supply circuit includes a parallel conversion section which converts the first and second serial data to the parallel data, the parallel conversion section having latching circuits corresponding in number to the sub-pixels, and control registers for controlling latching timing in the latching circuits, and the mode control circuit switches a part of the control registers into a non-active state in the second mode.

5. The display device of claim 2, wherein the first serial data in the first mode includes video data for red, green, blue, and white.

6. The display device of claim 1, wherein the signal supply circuit includes a parallel conversion section, and the parallel conversion section converts the first and second serial data to the parallel data.

7. The display device of claim 1, wherein the signal supply circuit includes a parallel conversion section which converts the first and second serial data to the parallel data, and a mode control circuit which controls the operation mode between the first mode and the second mode, the parallel conversion section having latching circuits corresponding in number to the sub-pixels, and control registers for controlling latching timing in the latching circuits, and the mode control circuit switches a part of the control registers into a non-active state in the second mode.

8. The display device of claim 1, wherein the first serial data in the first mode includes video data for red, green, blue and white.

9. A display device comprising:

a plurality of pixels comprising n sub-pixels, a signal supply circuit supplying one-bit data of n-bit parallel data to corresponding one of the sub-pixels, memories provided in the respective sub-pixels and each supplied with corresponding one-bit data, and pixel electrodes provided in the respective sub-pixels and each supplied with electric potential caused by one-bit data stored in corresponding one of the memories, wherein the signal supply circuit, in a first mode, receives n-bit serial data and supplies n-bit parallel data to the respective memories of the n sub-pixels based on the n-bit serial data, and in a second mode, receives m-bit serial data fewer than the n-bit serial data and supplies n-bit parallel data to the respective memories of the n sub-pixels based on the m-bit serial data.

10. The display device of claim 9, wherein n is 4, m is 3, and each of the pixels comprises a first sub-pixel, a second sub-pixel, a third sub-pixel, and a fourth sub-pixel.

11. The display device of claim 9, further comprising a mode control circuit, wherein the mode control circuit controls an operation mode between the first mode and the second mode.

12. The display device of claim 11, wherein the signal supply circuit includes a parallel conversion section, and the parallel conversion section converts the n-bit and m-bit serial data to n-bit parallel data.

13. The display device of claim 12, wherein the parallel conversion section having latching circuits corresponding to n sub-pixels, and control registers for controlling latching timing in the latching circuits, and the mode control circuit switches a part of the control registers into a non-active state in the second mode.

14. The display device of claim 9, wherein the n-bit serial data in the first mode includes video data for red, green, blue and white.

* * * * *